US006741220B2

(12) United States Patent
Inoue

(10) Patent No.: US 6,741,220 B2
(45) Date of Patent: May 25, 2004

(54) CROSS DIPOLE ANTENNA AND COMPOSITE ANTENNA

(75) Inventor: Jinichi Inoue, Koga (JP)

(73) Assignee: Nippon Antena Kabushiki Kaisha (JP)

( * ) Notice: Subject to any disclaimer, the term of this patent is extended or adjusted under 35 U.S.C. 154(b) by 0 days.

(21) Appl. No.: 09/959,904

(22) PCT Filed: Feb. 23, 2001

(86) PCT No.: PCT/JP01/01361

§ 371 (c)(1),
(2), (4) Date: Nov. 13, 2001

(87) PCT Pub. No.: WO01/67554

PCT Pub. Date: Sep. 13, 2001

(65) Prior Publication Data

US 2002/0158808 A1 Oct. 31, 2002

(30) Foreign Application Priority Data

Mar. 10, 2000 (JP) ..... 2000-066168
Sep. 22, 2000 (JP) ..... 2000-288921

(51) Int. Cl.[7] ..... H01Q 21/26
(52) U.S. Cl. ..... 343/797; 343/815; 343/817
(58) Field of Search ..... 343/793, 795, 343/797, 803, 810, 815, 817, 834; H01Q 21/26

(56) References Cited

U.S. PATENT DOCUMENTS

| | | | | |
|---|---|---|---|---|
| 3,742,510 A | | 6/1973 | Spanos | |
| 5,173,715 A | * | 12/1992 | Rodal et al. | 343/795 |
| 5,300,936 A | * | 4/1994 | Izadian | 343/700 MS |
| 6,072,439 A | * | 6/2000 | Ippolito et al. | 343/797 |
| 6,211,840 B1 | * | 4/2001 | Wood et al. | 343/793 |
| 6,329,954 B1 | | 12/2001 | Fuchs et al. | |
| 6,339,407 B1 | * | 1/2002 | Gabriel et al. | 343/797 |
| 6,342,867 B1 | | 1/2002 | Bell | |

FOREIGN PATENT DOCUMENTS

| | | |
|---|---|---|
| DE | 693092 | 7/1940 |
| EP | 0022991 A1 | 1/1981 |
| EP | 0568507 A1 | 11/1993 |
| GB | 982155 | 2/1965 |
| GB | 2272575 A | 5/1994 |
| JP | 56-050109 | 5/1981 |
| JP | 60-176305 | 9/1985 |
| JP | 62-216502 | 9/1987 |
| JP | 06-090113 | 3/1994 |
| JP | 07-094940 | 4/1995 |
| JP | 09-098019 | 4/1997 |
| JP | 2001-111327 | 4/2001 |
| WO | WO 00/69022 | 11/2000 |

OTHER PUBLICATIONS

A. Kumar et al., "A Shaped Beam Antenna for Data Transmission", APS Int Symp Dig; AP–S International Symposium (Digest) (IEEE Antennas and Propagation Society), vol. 4, May 7, 1997, XP010000691, pp. 1834–1837.
Supplementary European Search Report, EP01906260, Jan. 21, 2003, pp. 1–5.
Partial Supplementary European Search Report, EP01906260, Oct. 22, 2002, pp. 1–4.
International Search Report dated Jun. 5, 2001, International Appl. No. PCT/JP01/01361, 2 pages.

* cited by examiner

*Primary Examiner*—Tho Phan
(74) *Attorney, Agent, or Firm*—Connolly, Bove, Lodge & Hutz LLP

(57) ABSTRACT

A first dipole antenna consisting of dipole antennae 2*a*, 2*b* and a second dipole antenna consisting of dipole antennae 2*c*, 2*d* are disposed so as to be approximately orthogonal at approximately λ/4 intervals on a reflecting plate 6 having a diameter of approximately λ/2 or more. By disposing a plurality of non-feeding elements 3*a* to 3*h* around the first dipole antenna and second dipole antenna and isolating them by approximately λ/4, the transmission gain and axial ratio in a low elevation angle can be improved.

14 Claims, 23 Drawing Sheets

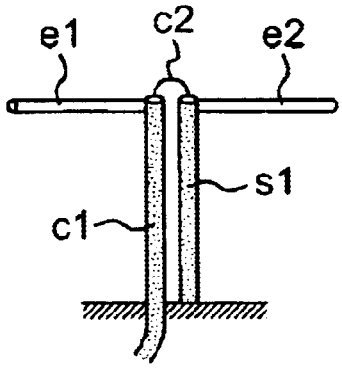
FIG. 8a
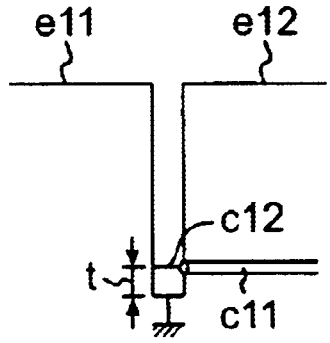
FIG. 8b
FIG. 8c
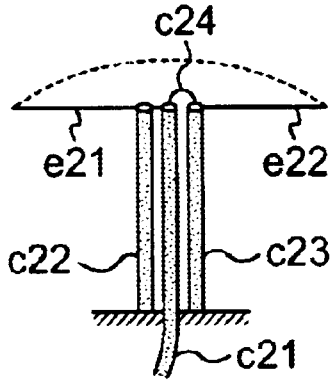
FIG. 8d
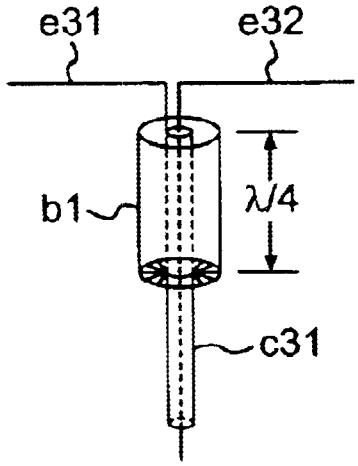

CROSS DIPOLE ANTENNA AND COMPOSITE ANTENNA

TECHNICAL FIELD

The present invention relates to a cross dipole antenna suitable for being installed in telecommunication equipment employing circularly polarized waves, and to a composite antenna suitable for being used in a communication system employing both circularly polarized waves and linearly polarized waves.

BACKGROUND ART

Various proposals have been made on satellite communication systems for the purpose of mobile communication employing circularly polarized waves. As the satellite communication system, there are a geosynchronous mobile satellite system employing a geosynchronous satellite and a non-geosynchronous mobile satellite system employing a non-geosynchronous satellite.

As the non-geosynchronous mobile satellite system, there are a system employing a low/medium-earth orbit satellite, a system employing a highly elliptical orbit satellite and a system employing an inclined geosynchronous orbit. Among the above, there is the LEO (Low Earth Orbit) communication system as the system employing a low/medium-earth orbit. This LEO communication system is a system having a small propagation delay time. Moreover, as the propagation loss is also small, there is an advantage in that the transmission power can be reduced and it is easy to miniaturize the size and lighten the weight of the terminal.

In addition, with this LEO communication system, there are a small scale LEO (Little LEO) for handling only data transmission and a large scale LEO (Big LEO) capable of voice transmission. The Iridium system and ICO (Intermediate Circular Orbit) system (Project 21) are included in this Big LEO. The communication method of the Iridium system is a TDMA (Time Division Multiple Access) method employing a frequency in a 1.6GHz band, and conducts communication with (66+6) non-geosynchronous satellites launched to an altitude of 780 km so as to cover the entire globe. These non-geosynchronous satellites are disposed at longitudinal 30° intervals for orbiting. In addition, the ICO system disposes 6 orbiting satellites in orthogonally inclined orbits of 10390 km, respectively, and the portable terminal thereof is a dual terminal capable of sharing satellite system networks utilizing satellites and existing ground system mobile phone systems.

With such satellite mobile communication systems, although numerous satellites are required, real-time voice and data communication is possible since the delay time can be disregarded. It is further possible to make the terminal portable since the transmission power of the terminal can be reduced. Thus, carrying a portable wireless device of such satellite mobile communication system will realize real-time communication and data transmission with telephones and mobile phones around the world. Circularly polarized waves suitable for portable wireless devices is employed in satellite mobile communication systems.

Incidentally, across dipole antenna or micro strip antenna capable of transmission and reception is employed in a portable wireless device of such satellite mobile communication systems since it is necessary to receive circularly polarized waves.

A cross dipole antenna is structured from two half-wavelength dipole antennae in which dipole antennae are orthogonally disposed in a cross shape. By mutually shifting the phase of two half-wavelength dipole antennae 90 degrees and exciting the same, circularly polarized waves are generated in a direction perpendicular to the face of the two half-wavelength dipole antennae. Here, as mutually opposing circularly polarized waves are generated in the two directions perpendicular to the face of the two half-wavelength dipole antennae, it is standard to place a reflecting plate at the position of approximately ¼ wavelength rearward of the two half-wavelength dipole antennae for unidirectional use. Further, in order to obtain circularly polarized waves within the range of a wide elevation angle, employed is an inverted V-shaped or inverted U-shaped dipole antenna which shows small directional change in the electric field face and magnetic field face.

FIG. 20 and FIG. 21 show a fundamental structure of a conventional cross dipole antenna capable of transmitting and receiving this type of circularly polarized waves. FIG. 20 is a diagram showing the fundamental structure of a cross dipole antenna 100 employing an inverted V-shaped dipole antenna, and FIG. 21 is a diagram showing the fundamental structure of a cross dipole antenna 200 employing an inverted V-shaped dipole antenna.

The cross dipole antenna 100 employed in the inverted V-shaped dipole antenna shown in FIG. 20 is structured of a reflecting plate 106, an inverted V-shaped first dipole antenna formed of dipole elements 102*a,* 102*b* disposed on such reflecting plate 106, and an inverted V-shaped second dipole antenna formed of dipole elements 102*c,* 102*d* disposed approximately orthogonal to the first dipole antenna.

This cross dipole antenna 100, although not shown, comprises a phase shifter circuit in the inverted V-shaped first dipole antenna and inverted V-shaped second dipole antenna for mutually shifting the phase approximately 90 degrees and exciting the same. The cross dipole antenna 100 can thereby be used as a an antenna capable of transmitting and receiving circularly polarized waves, and it can further obtain circularly polarized waves in a range of a wide elevation angle since it is formed of an inverted V-shaped first dipole antenna and an inverted V-shaped second dipole antenna.

The cross dipole antenna 200 employed in the inverted U-shaped dipole antenna shown in FIG. 21 is structured of a reflecting plate 206, an inverted U-shaped first dipole antenna formed of dipole elements 202*a,* 202*b* disposed on such reflecting plate 206, and an inverted U-shaped second dipole antenna formed of dipole elements 202*c,* 202*d* disposed approximately orthogonal to the first dipole antenna. This cross dipole antenna 200, although not shown, comprises a phase shifter circuit in the inverted U-shaped first dipole antenna and inverted U-shaped second dipole antenna for mutually shifting the phase approximately 90 degrees and exciting the same. The cross dipole antenna 200 can thereby be used as an antenna capable of transmitting and receiving circularly polarized waves, and it can further obtain circularly polarized waves in a range of a wide elevation angle since it is formed of an inverted U-shaped first dipole antenna and an inverted U-shaped second dipole antenna.

Since the aforementioned cross dipole antennae are capable of transmitting and receiving circularly polarized waves, they may be employed in communication systems utilizing circularly polarized waves, such as satellite communication antennae and so on. Next, FIG. 22 and FIG. 23 show the concrete structure of the conventionally proposed cross dipole antenna capable of transmitting and receiving circularly polarized waves. FIG. 22, however, is a plan view of the cross dipole antenna and FIG. 23 is the front view thereof. This cross dipole antenna may be installed in automobiles, ships and vessels, aircraft, portable devices, and so forth.

The cross dipole antenna 300 illustrated in these diagrams is structured of two dipole antennae disposed to be approximately orthogonal and a reflecting plate 306. The diameter D3 of the approximately circular reflecting plate 306 is approximately $\lambda/2$ to $\lambda$ when the wavelength of the center frequency in the used frequency band is set to $\lambda$. The two dipole antennae disposed to be approximately orthogonal are structured from a first inverted U-shaped dipole antenna and a second U-shaped dipole antenna being orthogonally disposed. The first inverted U-shaped dipole antenna is structured from a dipole element 302*a* and a dipole element 302*b*, and the second inverted U-shaped dipole antenna is structured from a dipole element 302*c* and a dipole element 302*d*. Dipole elements 302*a* to 302*d* are formed of metal plates, and the approximate center thereof is folded toward the reflecting plate 306, and the end thereof is directed toward the reflecting plate 306. The length L302 of dipole elements 302*a* to 302*d* is approximately $\lambda/4$.

In this cross dipole antenna 300, the length L301 between one end of dipole elements 302*a* to 302*d* and the reflecting plate 306 is set be approximately $\lambda/4$. In other words, the length from the reflecting plate 306 of a coaxial semi-rigid cable 304*a* for exciting the first inverted U-shaped dipole antenna structured from dipole element 302*a* and dipole element 302*b* is approximately $\lambda/4$. Similarly, the length from the reflecting plate 306 of a coaxial semi-rigid cable 304*c* for exciting the second inverted U-shaped dipole antenna structured from dipole element 302*c* and dipole element 302*d* is also approximately $\lambda/4$. Moreover, the length from a short pole 304*b* and short pole 304*d* in which the lower end thereof is short-circuited to the reflecting plate 306 is also approximately $\lambda/4$.

One end of the dipole element 302*a* is connected to and excited by a covered conductor at the tip of the coaxial semi-rigid cable 304*a*, and one end of the dipole element 302*b* is connected to and excited by the tip of the short pole 304*b*. A center conductor 302*e* of the coaxial semi-rigid cable 304*a* is connected to the tip of this short pole 304*b*. Further, one end of the dipole element 302*c* is connected to and excited by a covered conductor at the tip of the coaxial semi-rigid cable 304*c*, and one end of the dipole element 302*d* is connected to and excited by the tip of the short pole 304*d*. A center conductor 302*f* of the coaxial semi-rigid cable 304*c* is connected to the tip of this short pole 304*d*.

Moreover, coaxial semi-rigid cables 304*a*, 304*c* penetrating through and extending below the reflecting plate 306 are connected to a phase delay circuit 307, coaxial semi-rigid cable 304*a* is excited at 0° phase, and coaxial semi-rigid cable 304*c* is excited at a 90° delayed phase. Thereby, the phase of the first inverted U-shaped dipole antenna and the second inverted U-shaped dipole antenna differ at approximately 90°, and circularly polarized waves are irradiated pursuant to the excitation from a feeder unit 308.

FIG. 24 illustrates the directivity characteristic inside the perpendicular face of the cross dipole antenna 300 structured as described above. Upon reviewing this directivity characteristic, it is clear that the antenna gain gradually decreases and the axial ratio of the circularly polarized waves deteriorates and becomes an elliptical polarization in the direction of a low elevation angle in which the angle becomes larger from the apex direction.

As described above, with a conventionally proposed cross dipole antenna, the antenna gain decreases and the axial ratio of the circularly polarized waves also deteriorates in the direction of a low elevation angle. This constitutes a problem in a communication system employing circularly polarized waves.

In other words, there are cases where radio waves arrive from the direction of a low elevation angle in a communication system employing circularly polarized waves. Particularly in a satellite communication system, a satellite is generally not geosynchronous and the apparent movement speed of the satellite in a position where the elevation angle is high becomes large. This implies that the existing possibility of a satellite in a low elevation angle of approximately 70° to 90° upon setting the zenith direction to 0° becomes high. Thus, a conventional cross dipole antenna has a problem in that the transmission gain is small in a low elevation angle where the existing possibility of a satellite is high, and the axial ratio deteriorates as well.

Meanwhile, a satellite digital sound broadcast system for conducting digital sound broadcast utilizing satellites has been proposed. FIG. 25 illustrates the schematic structure of this satellite digital sound broadcast system.

As shown in FIG. 25, the satellite digital sound broadcast system transmits digital sound broadcasting programs produced by a plurality of providers from the earth station 171 to the broadcasting satellite 170, and transmits such programs to the assigned territories on earth from the broadcasting satellite 170 based on the control of the ground-side controlling station. Radio waves of the digital sound broadcast transmitted from this broadcasting satellite 170 are circularly polarized waves, and are received by a movable mobile body 182. Here, in the cities where skyscrapers are standing side by side, blind areas may arise because radio waves from the broadcasting satellite 170 do not reach such areas.

Thus, in order to enable favorable reception of sound broadcasting by the mobile body 182 in the cities where blind areas easily arise, terrestrial broadcasting is conducted from the earth broadcasting station 181. The digital sound broadcasting programs broadcast from the earth broadcast station 181 are the same as the digital sound broadcasting programs broadcast from the broadcasting satellite 170, and the terrestrial broadcasting and satellite broadcasting are broadcast in synchronization. Moreover, terrestrial broadcasting is transmitted in linearly polarized waves from the earth broadcasting station in order to suppress interference. Transmitted to the earth broadcasting station 181 are digital sound broadcasting programs broadcast terrestrially from the ground-side controlling station (not shown) and digital sound broadcast programs from the earth station 171. Further, it is possible to obtain digital sound broadcast programs broadcast terrestrially from a satellite broadcast transmitted from the broadcasting satellite 170. The frequency band of the terrestrial broadcasting is made identical or adjacent to the frequency band of the satellite broadcasting.

The mobile body 182 capable of receiving the satellite broadcast or terrestrial broadcast is equipped with an antenna 182*a* having a circular polarization antenna and linear polarization antenna, and selects and receives a favorable reception by detecting the reception power and so on of both broadcasts. This type of satellite digital broadcast system has been put into practical application as Sirius satellite radio and XM satellite radio.

A circular polarization antenna capable of receiving circularly polarized waves are required for a mobile reception terminal to receive the digital sound broadcast transmitted from the broadcasting satellite 170, and a linear polarization antenna capable of receiving linearly polarized waves are further required upon receiving digital sound broadcasts in cities where blind areas easily arise. That is, two antennae; namely, a satellite system antenna and a ground system antenna, are required.

The cross dipole antenna illustrated in FIGS. 20 to 23 described above is an antenna capable of receiving circularly polarized waves. Nevertheless, although this type of cross dipole antenna is capable of receiving circularly polarized waves and linearly polarized waves, the transmission gain decreases in comparison to an antenna dedicated to linearly polarized waves with respect to the linearly polarized waves transmitted horizontally from the earth station. Therefore, regarding the antenna in a mobile reception terminal in a satellite digital sound broadcast system illustrated in FIG. 25, there is a problem in that it is necessary to separately install a ground antenna such as a whip antenna, for example, in addition to installing a satellite antenna such as a cross dipole antenna.

DISCLOSURE OF THE INVENTION

Thus, the first cross dipole antenna of the present invention comprises: a reflecting plate; a first dipole antenna disposed at a prescribed interval on the reflecting plate; a second dipole antenna disposed at a prescribed interval on the reflecting plate so as to be approximately orthogonal to the first dipole antenna; and a plurality of non-feeding elements disposed around the first dipole antenna and second dipole antenna and uprising from the reflecting plate.

According to this type of invention, since a plurality of non-feeding elements are provided so as to be disposed around the approximately orthogonal first dipole antenna and second dipole antenna and uprising from the reflecting plate, it is possible to suppress the decrease of gain in a low elevation angle and to significantly improve the axial ratio characteristic of circularly polarized waves. In other words, the non-feeding elements act as the wave director and improve the antenna characteristic in the direction of the low elevation angle.

Moreover, in the aforementioned first cross dipole antenna of the present invention, the first dipole antenna and second dipole antenna may be structured by being folded toward the reflecting plate.

Furthermore, in the aforementioned first cross dipole antenna of the present invention, the non-feeding elements may be fixated on the reflecting plate via insulation spacers.

Next, the second cross dipole antenna of the present invention comprises: a reflecting plate formed in which the reflecting face is inclined such that the center portion protrudes further than the peripheral portion; a first dipole antenna disposed at a prescribed interval on the reflecting plate; and a second dipole antenna disposed at a prescribed interval on the reflecting plate so as to be approximately orthogonal to the first dipole antenna. By forming the reflecting plate such that the peripheral portion is inclined downward so as to be positioned lower than the center portion, it is possible to suppress the decrease of gain in a low elevation angle and to significantly improve the axial ratio characteristic of circularly polarized waves.

Moreover, in the aforementioned second cross dipole antenna of the present invention, the dipole antenna and second dipole antenna may be structured by being folded toward the reflecting plate.

Furthermore, the aforementioned second cross dipole antenna of the present invention may further comprise a plurality of non-feeding elements disposed around the first dipole antenna and second dipole antenna and uprising from the reflecting plate.

In addition, in the aforementioned second cross dipole antenna of the present invention, the non-feeding elements may be fixated on the reflecting plate via insulation spacers.

Next, the composite antenna of the present invention is a composite antenna in which a cross dipole antenna capable of receiving circularly polarized waves and a whip antenna capable of receiving linearly polarized waves of an identical or adjacent frequency band to such circularly polarized waves are provided on a reflecting plate; wherein the cross dipole antenna is formed of a first dipole antenna disposed at a prescribed interval on the reflecting plate and a second dipole antenna disposed at a prescribed interval on the reflecting plate so as to be approximately orthogonal to the first dipole antenna; the whip antenna is fixated on the reflecting plate by being isolated from the cross dipole antenna at more than approximately ¼ wavelength of the wavelength in the center frequency of the used frequency band; and the cross dipole antenna is capable of receiving broadcast signals of circularly polarized waves transmitted from a satellite and the whip antenna is capable of receiving broadcast signals of linearly polarized waves of identical contents as with the broadcast signals transmitted from the ground.

According to this type of invention, since a whip antenna capable of transmitting and receiving linearly polarized waves is provided on the reflecting plate structuring the cross dipole antenna, installation of a single composite antenna will enable the reception of both linearly polarized waves and circularly polarized waves. Therefore, upon receiving digital sound broadcast with a mobile reception terminal, it is no longer necessary to install two antennae; namely, a satellite system antenna and a ground system antenna, and a single composite antenna will suffice.

Moreover, another composite antenna of the present invention is a composite antenna in which a cross dipole antenna capable of receiving circularly polarized waves and a whip antenna capable of receiving linearly polarized waves of an identical or adjacent frequency band to the circularly polarized waves are provided on a reflecting plate; wherein the cross dipole antenna is formed of a first dipole antenna disposed at a prescribed interval on the reflecting plate, a second dipole antenna disposed at a prescribed interval on the reflecting plate so as to be approximately orthogonal to the first dipole antenna, and a plurality of non-feeding elements disposed around the first dipole antenna and second dipole antenna and uprising from the reflecting plate; the whip antenna is fixated on the reflecting plate by being isolated from the cross dipole antenna at more than approximately ¼ wavelength of the wavelength in the center frequency of the used frequency band; and the whip antenna is also used as the non-feeding elements.

According to this type of invention, by disposing a plurality of non-feeding elements around the cross dipole antenna, it is possible to suppress the decrease of gain in a low elevation angle and to significantly improve the axial ratio characteristic of circularly polarized waves. In other words, the non-feeding elements act as the wave director and improve the antenna characteristic in the direction of the low elevation angle. Further, since a whip antenna, which is a ground antenna, can also be used as the non-feeding element, a composite antenna can be structured with only an approximate structure of a cross dipole antenna. The composite antenna can thereby be miniaturized.

Moreover, in the aforementioned composite antenna of the present invention, the first dipole antenna and second dipole antenna may be structured by being folded toward the reflecting plate.

Furthermore, in the aforementioned composite antenna of the present invention, the non-feeding elements may be fixated on the reflecting plate via insulation spacers.

Moreover, in the aforementioned composite antenna of the present invention, the reflecting face may be inclined such that the center portion of the reflection plate protrudes further than the peripheral portion. According to the above, it is possible to further suppress the decrease of gain in a low elevation angle and to significantly improve the axial ratio characteristic of circularly polarized waves.

Furthermore, in the aforementioned composite antenna of the present invention, the cross dipole antenna may be made to be capable of receiving broadcast signals of circularly polarized waves transmitted from a satellite and the whip antenna may be made to be capable of receiving broadcast signals of linearly polarized waves of identical contents as with the broadcast signals transmitted from the ground.

Moreover, in the aforementioned composite antenna of the present invention, the plurality of non-feeding elements are disposed circumferentially with the cross dipole antenna in the approximate center, and the whip antenna may be disposed on the outer side of the circumference.

BRIEF DESCRIPTION OF THE DRAWINGS

FIG. 8A illustrates a balance-unbalanced circuit of a first and second embodiment of the invention.

FIG. 8B illustrates a balance-unbalanced circuit of another embodiment of the invention.

FIG. 8C illustrates a third balanced-unbalanced circuit of another embodiment of the invention.

FIG. 8D illustrates a balance-unbalanced circuit of a fourth embodiment of the invention.

BEST MODE FOR CARRYING OUT THE INVENTION

Figure 1:
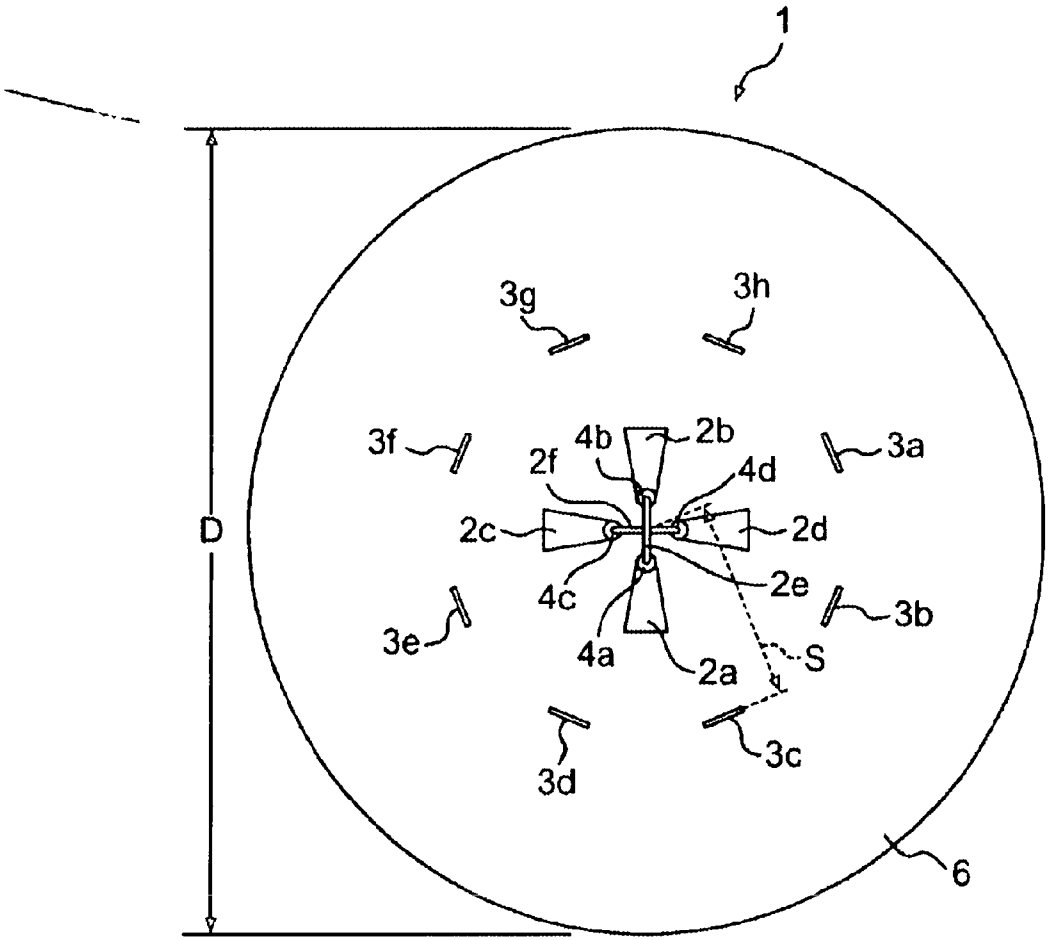
FIG. 1 is a plan view showing the structure of the first embodiment of the cross dipole antenna of the present invention.
Figure 2:
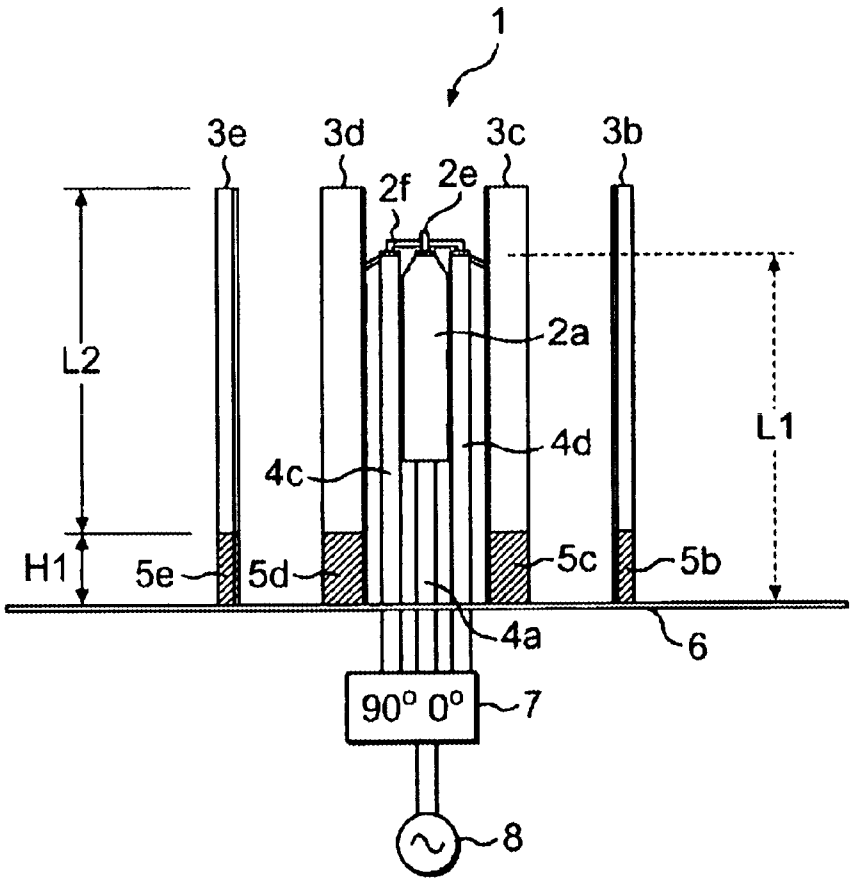
FIG. 2 is a front view showing the structure of the first embodiment of the cross dipole antenna of the present invention.

FIG. 1 illustrates the plan view showing the structure of the first embodiment of the cross dipole antenna of the present invention, and FIG. 2 illustrates the front view thereof.

The first cross dipole antenna 1 according to the first embodiment of the present invention shown in FIG. 1 and FIG. 2 is structured from two dipole antennae disposed to be approximately orthogonal, and a reflecting plate 6. The reflecting plate 6 is of an approximate circular form and the diameter D thereof is approximately λ/2 to λ upon setting the wavelength of the center frequency in a used frequency band to λ. The two dipole antennae disposed to be approximately orthogonal are structured by disposing a first inverted U-shaped dipole antenna and a second inverted U-shaped dipole antenna to be approximately orthogonal. The first inverted U-shaped dipole antenna is structured from a dipole element 2*a* and a dipole element 2*b* folded in an inverted U shape, respectively, and the second inverted U-shaped dipole antenna is structured from a dipole element 2*c* and a dipole element 2*d* folded in an inverted U shape. Dipole elements 2*a* to 2*d* structuring the two inverted U-shaped dipole antennae are formed in a plate shape as shown in FIG. 2 by processing a metal plate, the approximate center thereof is folded into an inverted U shape toward the reflecting plate 6, and the end thereof is made to face the reflecting plate 6. Moreover, the length of dipole elements 2*a* to 2*d* is approximately λ/4. In other words, the first inverted U-shaped dipole antenna and second inverted U-shaped dipole antenna are half-wavelength dipole antennae.

In the first cross dipole antenna 1 according to an embodiment of the present invention, the length L1 shown in FIG. 2 between one end of dipole elements 2*a* to 2*d* and the reflecting plate 6 is approximately λ/4. In other words, the length from the reflecting plate 6 of a coaxial semi-rigid cable 4*a* for exciting the first inverted U-shaped dipole antenna structured from dipole element 2*a* and dipole element 2*b* is approximately λ/4. Similarly, the length from the reflecting plate 6 of a coaxial semi-rigid cable 4*c* for exciting the second inverted U-shaped dipole antenna structured from dipole element 2*c* and dipole element 2*d* is also approximately λ/4. Moreover, the length from a short pole 4*b* and short pole 4*d* in which the lower end thereof is short-circuited to the reflecting plate 6 is also approximately λ/4.

One end of the dipole element 2*a* is connected to and excited by a covered conductor at the tip of the coaxial semi-rigid cable 4*a,* and one end of the dipole element 2*b* is connected to and excited by the tip of the short pole 4*b*. A center conductor 2*e* of the coaxial semi-rigid cable 4*a* is connected to the tip of this short pole 4*b*. Further, one end of the dipole element 2*c* is connected to and excited by a covered conductor at the tip of the coaxial semi-rigid cable 4*c,* and one end of the dipole element 2*d* is connected to and excited by the tip of the short pole 4*d*. A center conductor 2*f* of the coaxial semi-rigid cable 4*c* is connected to the tip of this short pole 4*d*.

Moreover, coaxial semi-rigid cables 4*a,* 4*c* penetrating through and extending below the reflecting plate 6 are connected to a phase delay circuit 7, an excitation signal is output to the coaxial semi-rigid cable 4*a* from the feeder unit 8 at a 0° phase delay, and an excitation signal is output to the coaxial semi-rigid cable 4*c* from the feeder unit 8 at a 90° phase delay. Thus, as the first inverted U-shaped dipole antenna and the second inverted U-shaped dipole antenna are excited such that the phases thereof mutually shift at approximately 90° pursuant to the excitation from the feeder unit 8, circularly polarized waves are irradiated in an approximate perpendicular direction to the face perpendicular to the face of the cross dipole antenna 1; that is, the face of the reflecting plate 6. Here, the antiphase circularly polarized waves component irradiated in the direction of the reflecting plate 6 is reflected by the reflecting plate 6 so as to be antiphase, and it is irradiated in an approximate perpendicular upper direction to the face of the reflecting plate 6 as an in-phase with the component irradiated in the opposite direction to the reflecting plate 6.

The unique structure in the first embodiment of the cross dipole antenna of the present invention is that a plurality of non-feeding elements 3*a* to 3*h* are disposed at approximate intervals around a first inverted U-shaped dipole antenna and a second inverted U-shaped dipole antenna formed of dipole elements 2*a* to 2*d* and disposed to be approximately orthogonal. For example, the number of non-feeding elements 3*a* to 3*h* is set to be 8 elements, and are uprising approximately perpendicularly to the reflecting plate 6. The length L2 shown in FIG. 2 of these non-feeding elements 3*a* to 3*h* is approximately λ/4, and insulation spacers 5*a* to 5*h* are provided at the lower end thereof. The lower end of these insulation spacers 5*a* to 5*h* is fixated on the reflecting plate 6, and the height H1 thereof is, for example, approximately 0.04λ. Further, the non-feeding elements 3*a* to 3*h* are isolated and disposed at interval S (c.f. FIG. 1) from the center of the first inverted U-shaped dipole antenna and second inverted U-shaped dipole antenna disposed to be approximately orthogonal, and such interval S is approximately λ/4. Moreover, the non-feeding elements 3*a* to 3*h* are formed into a plate shape as shown in FIG. 2 by processing a metal plate.

Figure 3:
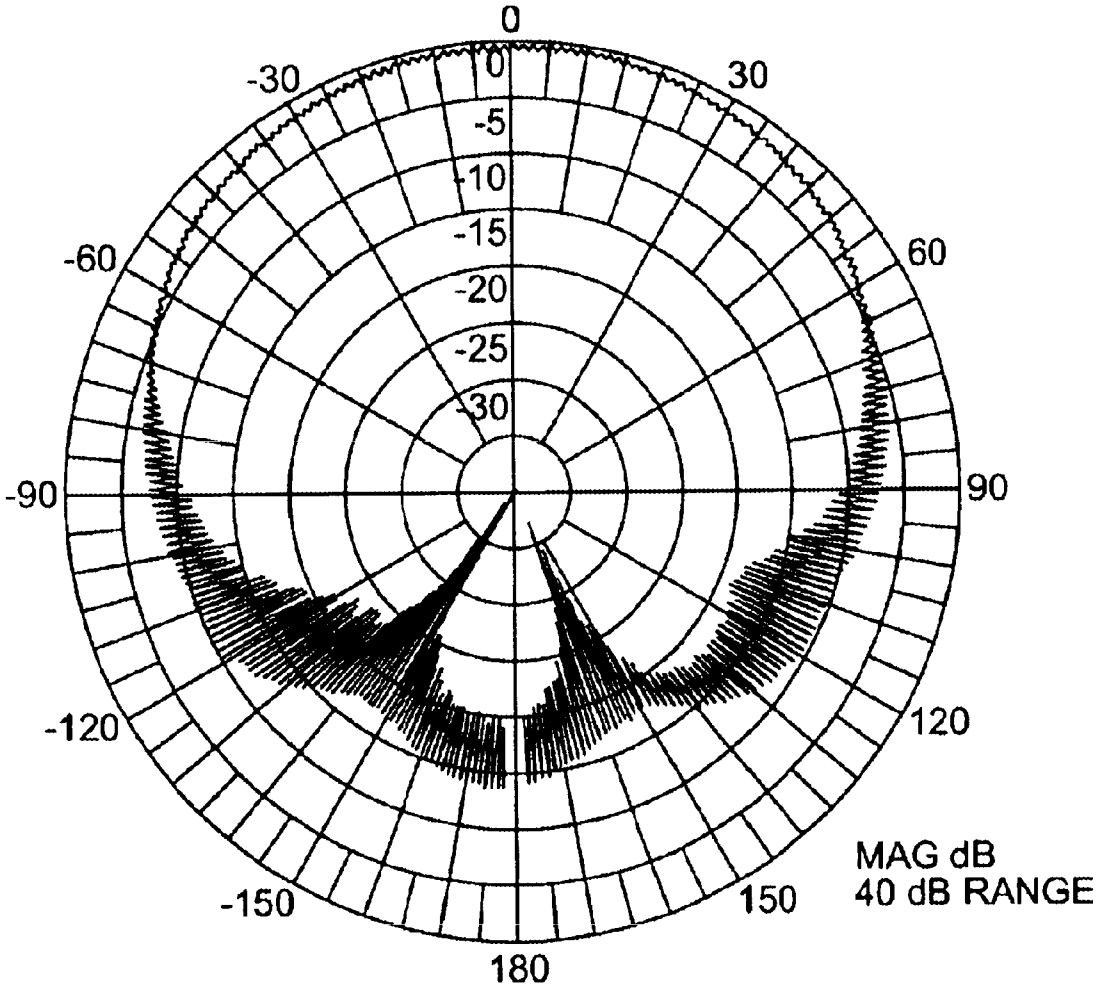
FIG. 3 is a diagram showing the directivity characteristic inside the perpendicular face in the first embodiment of the cross dipole antenna of the present invention.

FIG. 3 illustrates the directivity characteristic inside the perpendicular face of the first cross dipole antenna according to an embodiment of the present invention structured as described above. Upon reviewing this directivity characteristic, in comparison to the directivity characteristic of conventional cross dipole antennae, the decrease of gain is suppressed in a low elevation angle in which the angle from the apex direction became approximately 60 degrees or larger and the axial ratio characteristic of circularly polarized waves is also significantly improved. In addition, a certain degree of antenna gain can be secured even in the direction of magnetic dip where the angle is greater than 90°, and the axial ratio of circularly polarized waves is also improved. This is because the non-feeding elements 3*a* to 3*h* work as directors and improve the antenna characteristics in low elevation angles.

Figure 4:
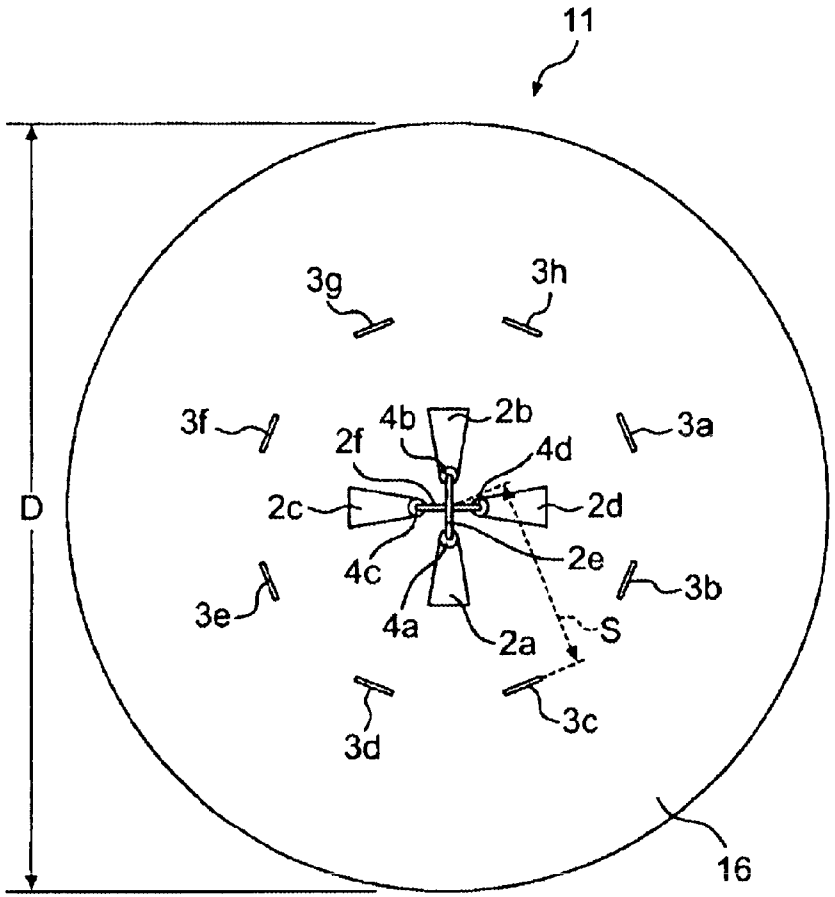
FIG. 4 is a plan view showing the structure of the second embodiment of the cross dipole antenna of the present invention.
Figure 5:
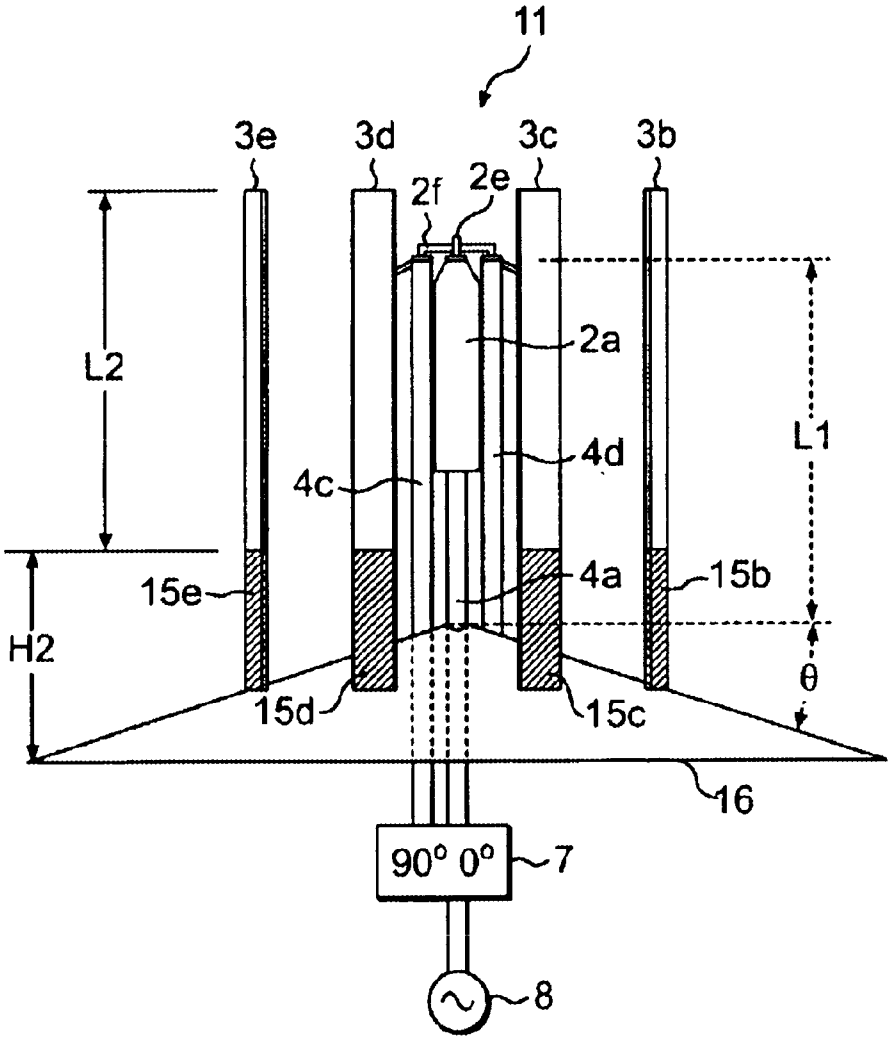
FIG. 5 is a front view showing the structure of the second embodiment of the cross dipole antenna of the present invention.
Figure 6A:
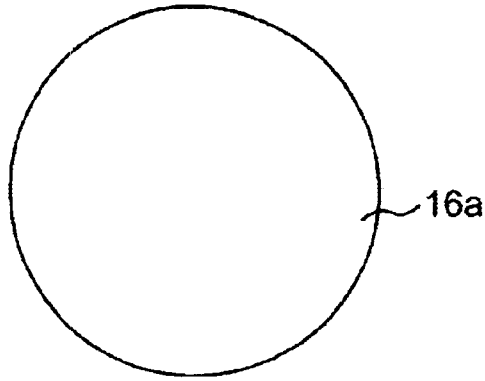
FIG. 6A shows a plan view of the reflecting plate 16A.
Figure 6B:
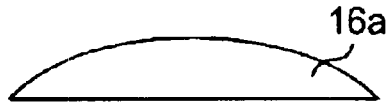
FIG. 6B shows a front view of the reflecting plate of FIG. 6A.
Figure 6C:
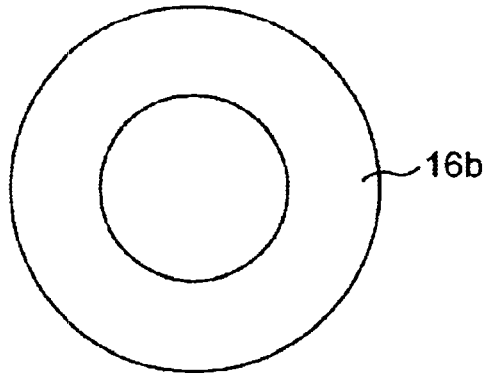
FIG. 6C shows a plan view of a reflecting plate of another shape.
Figure 6D:
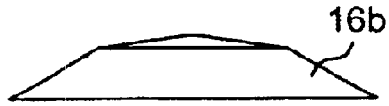
FIG. 6D shows the plan view of another shape for the reflecting plate.
Figure 6E:
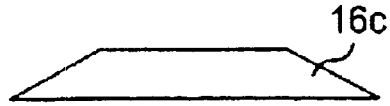
FIG. 6E illustrates a front view of the reflecting plate of FIG. 6D.

Next, FIG. 4 illustrates the plan view showing the second structure according to an embodiment of the cross dipole antenna of the present invention, and FIG. 5 illustrates the front view thereof.

The second cross dipole antenna 11 according to an embodiment of the present invention shown in FIG. 4 and FIG. 5 endeavors to further improve the directivity characteristic inside the perpendicular face of the first cross dipole antenna according to an embodiment of the present invention. Accordingly, with the second cross dipole antenna 11 according to an embodiment of the present invention, the structure of the reflecting plate 6 of the first cross dipole antenna 1 according to an embodiment of the present invention is changed along with other structural changes pursuant thereto. Such structural changes are described in principle below.

The second cross dipole antenna 11 according to an embodiment of the present invention is also structured of two dipole antennae disposed to be approximately orthogonal, a reflecting plate 16, and a plurality of non-feeding elements 3*a* to 3*h*. The two dipole antennae disposed to be approximately orthogonal are structured by disposing a first inverted U-shaped dipole antenna and a second inverted U-shaped dipole antenna to be approximately orthogonal. The first inverted U-shaped dipole antenna is structured from a dipole element 2*a* and a dipole element 2*b* folded in an inverted U shape, respectively, and the second inverted U-shaped dipole antenna is structured from a dipole element 2*c* and a dipole element 2*d* folded in an inverted U shape. Dipole elements 2*a* to 2*d* structuring the two inverted U-shaped dipole antennae are formed in a plate shape as shown in FIG. 5 by processing a metal plate, the approximate center thereof is folded into an inverted U shape toward the reflecting plate 16, and the end thereof is made to face the reflecting plate 16. Moreover, the length of dipole element 2*a* to 2*d* is approximately λ/4. In other words, the first inverted U-shaped dipole antenna and second inverted U-shaped dipole antenna are half-wavelength dipole antennae. This aforementioned structure is the same as the structure of the first cross dipole antenna 1 according to an embodiment of the present invention.

Furthermore, the length L1 shown in FIG. 5 between one end of dipole element 2*a* to 2*d* and the apex portion of the reflecting plate 16 is approximately λ/4. In other words, the length from the apex portion of the reflecting plate 6 of a coaxial semi-rigid cable 4*a* for exciting the first inverted U-shaped dipole antenna and a coaxial semi-rigid cable 4*c* for exciting the second inverted U-shaped dipole antenna is approximately λ/4. Moreover, the length from a short pole 4*b* and short pole 4*d* in which the lower end thereof is short-circuited to the apex portion of the reflecting plate 16 is also approximately λ/4.

Moreover, the connective relationship between the dipole elements 4*a*, 4*c* and the reflecting plate 16 as well as the connective relationship between the dipole elements 2*b*, 2*d* and the short poles 4*b*, 4*d* are the same as those of the first cross dipole antenna 1 according to the foregoing embodiment.

Furthermore, coaxial semi-rigid cables 4*a*, 4*c* are fixated on the reflecting plate 16, penetrate through the reflecting plate 16 and connected to a phase delay circuit 7. Thereby, an excitation signal is output to the coaxial semi-rigid cable 4*a* from the feeder unit 8 at a 0° phase delay, and an excitation signal is output to the coaxial semi-rigid cable 4*c* from the feeder unit 8 at a 90° phase delay. Thus, as the first inverted U-shaped dipole antenna and the second inverted U-shaped dipole antenna are excited such that the phases thereof mutually shift at approximately 90° pursuant to the excitation from the feeder unit 8, circularly polarized waves are irradiated in an approximate perpendicular direction to the face perpendicular to the face of the cross dipole antenna 11. Here, the antiphase circular polarization component irradiated in the direction of the reflecting plate 16 is reflected by the reflecting plate 16 so as to be antiphase, and it is irradiated in an approximate perpendicular upper direction to the face of the reflecting plate 16 as an in-phase with the component irradiated in the opposite direction to the reflecting plate 16.

Further, a plurality of non-feeding elements 3*a* to 3*h* are disposed at approximate intervals around a first inverted U-shaped dipole antenna and a second inverted U-shaped dipole antenna disposed to be approximately orthogonal. For example, the number of non-feeding elements 3*a* to 3*h* is set to be 8 elements. The length L2 of these non-feeding elements 3*a* to 3*h* is approximately λ/4, and insulation spacers 15*a* to 15*h* are provided at the lower end thereof. The lower end of these insulation spacers 15*a* to 15*h* is fixated on the reflecting plate 16, and the height H2 thereof is, for example, approximately 0.15λ. Further, as shown in FIG. 4, the non-feeding elements 3*a* to 3*h* are isolated and disposed at interval S from the center of the first inverted U-shaped dipole antenna and second inverted U-shaped dipole antenna disposed to be approximately orthogonal, and such interval S is approximately λ/4.

With the second cross dipole antenna 11 according to an embodiment of the present invention, the structure of the reflecting plate 16 is additionally unique. As shown in FIG. 5, the reflecting plate 16 is formed in a conical shape, and the diameter D of the approximately circular reflecting plate 16 is approximately λ/2 to λ. Moreover, it is preferable that the magnetic dip θ inclined downward of the reflecting plate 16 be set in a range of $0° < \theta < 60°$.

Figure 7:
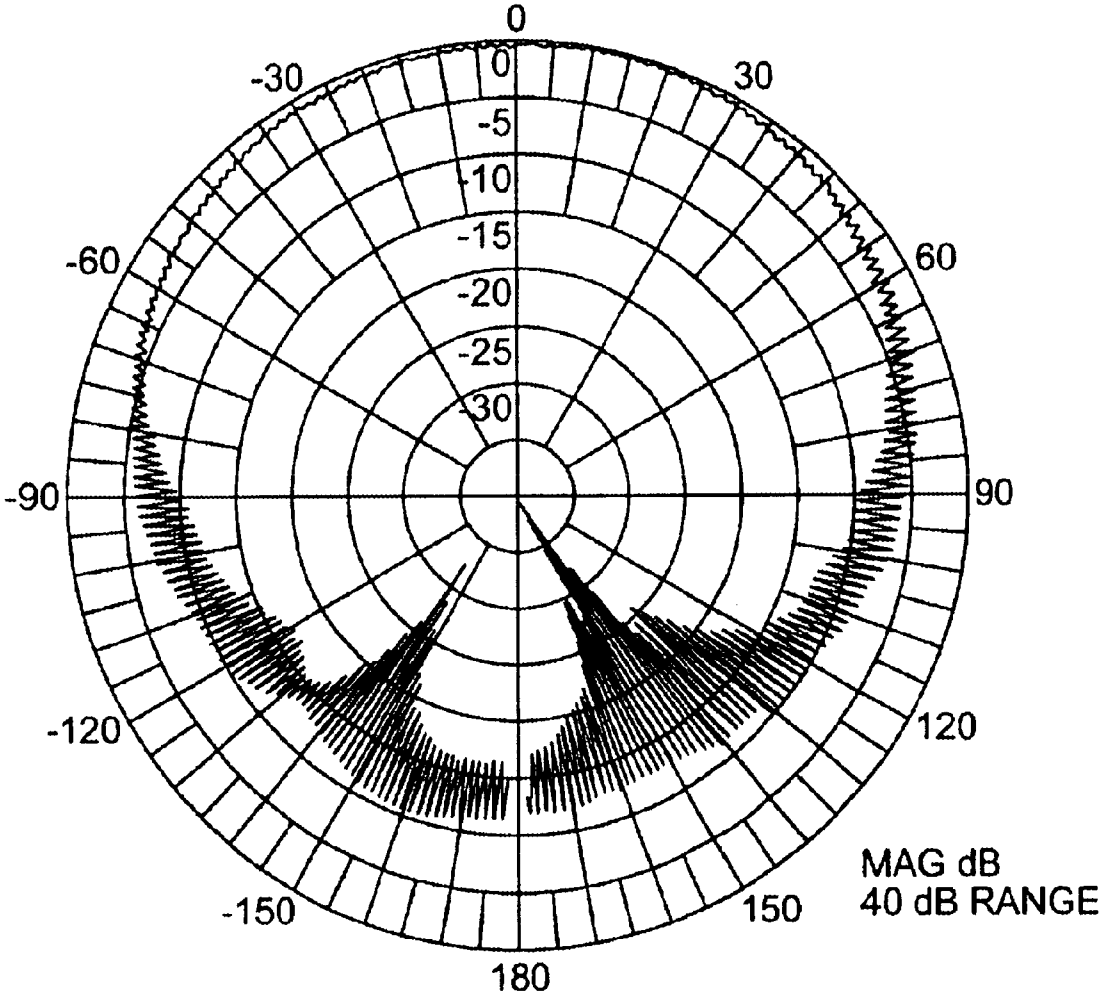
FIG. 7 is a diagram showing the directivity characteristic inside the perpendicular face in the second embodiment of the cross dipole antenna of the present invention.

FIG. 7 illustrates the directivity characteristic inside the perpendicular face of the second cross dipole antenna 11 according to an embodiment of the present invention structured as described above. Upon reviewing this directivity characteristic, the decrease of gain is suppressed in a low elevation angle in which the angle from the apex direction became approximately 60 degrees or larger and the axial ratio characteristic of circularly polarized waves is also significantly improved. In addition, a certain degree of antenna gain can be secured even in the direction of magnetic dip where the angle is greater than 90°, and the axial ratio of circularly polarized waves is also improved.

Incidentally, the reflecting plate 16 of the second cross dipole antenna 11 according to an embodiment of the present invention is not limited to a conical shape, and may be of a shape shown in FIG. 6.

The reflecting plate 16*a* in which the plan view thereof constitutes a shape shown in FIG. 6(*a*) and the front view thereof constitutes a shape shown in FIG. 6(*b*) is a reflecting plate 16*a* having a shape of cutting away a sphere. Further, the reflecting plate 16*b* in which the plan view thereof constitutes a shape shown in FIG. 6(*c*) and the front view thereof constitutes a shape shown in FIG. 6(*d*) is a conical reflecting plate 16*b* wherewith the magnetic dip changes in two stages. Moreover, the reflecting plate 16*c* in which the front view thereof constitutes a shape shown in FIG. 6(*e*) is a trapezoidal reflecting plate 16*c* wherewith the apex portion of the conical shape is flat. A reflecting plate having any of the foregoing shapes is able to suppress the decrease of gain in a low elevation angle and to significantly improve the axial ratio characteristic of circularly polarized waves.

Since each of the reflecting plates 16 to 16*c* in the second cross dipole antenna 11 according to the present embodiment is formed in which the reflection face is inclined such that the center portion thereof protrudes more than the peripheral portion thereof, the circular polarization component reflected by the reflection plates 16 to 16*c* is irradiated toward the low elevation angle direction. The second cross dipole antenna 11 according to an embodiment of the present invention is thereby able to improve the irradiation characteristic in a low elevation angle. As described above, since the second cross dipole antenna 11 according to the present invention improves the irradiation characteristic in a low elevation angle pursuant to the reflection plates 16 to 16*c*, the structure may omit the non-feeding elements 3*a* to 3*h*.

Incidentally, in the first embodiment and second embodiment of the cross dipole antenna of the present invention, a balanced-unbalanced circuit is provided for converting the unbalanced circuit (coaxial semi-rigid cable) into a balanced circuit (dipole element) since the dipole element is excited with a coaxial semi-rigid cable. Several balanced-unbalanced circuits are shown in FIGS. 8(*a*) to (*d*). Nevertheless, as such balanced-unbalanced circuits have been employed from the past, explanation of its operation principle will be omitted.

The balanced-unbalanced circuit shown in FIG. 8(*a*) is the balanced-unbalanced circuit employed in the first embodiment and second embodiment of the cross dipole antenna of the present invention. In other words, the coaxial semi-rigid cables 4*a,* 4*c* correspond to the coaxial cable c1, short poles 4*b,* 4*d* correspond to the short circuit s1, dipole elements 2*a,* 2*c* correspond to dipole element e1, and dipole elements 2*b,* 2*d* correspond to dipole element e2.

The cross dipole antenna of the present invention is not limited to the balanced-unbalanced circuit shown in FIG. 8(*a*), and may also employ the balanced-unbalanced circuits shown in FIGS. 8(*b*), (*c*) and (*d*). The balanced-unbalanced circuits shown in FIGS. 8(*b*), (*c*) and (*d*) are now briefly described.

In the balanced-unbalanced circuit shown in FIG. 8(*b*), dipole elements e11, e12 are folded in an L shape, and the folded end portions are connected and short-circuited to the earth. From the position of the connected end portions to the position of length t, the covered conductor of the coaxial cable c11 is connected to one of the dipole elements e12, and the center conductor c12 is connected to the other dipole element e11. The length t may be adjusted to arrange the balance.

In the balanced-unbalanced circuit shown in FIG. 8(*c*), dipole elements e21, e22 are respectively connected to the ends of short-circuit lines c22, c23 short-circuited to the earth and having a length of approximately λ/4. Moreover, the covered conductor of the coaxial cable c21 for exciting the dipole elements e21, e22 is connected to the end of the short-circuit line c22, and the center conductor c24 is connected to the end of the other short-circuit line c23.

In the balanced-unbalanced circuit shown in FIG. 8(*d*), the lower end of a super top b1 having a length of λ/4 is connected to the covered conductor at a position approximately λ/4 from the end of the coaxial cable c31 for exciting the dipole elements e31, e32. Then, the dipole element e31 is connected to the end of the covered conductor of the coaxial cable c31, and the dipole element e32 is connected to the end of the center conductor of the coaxial cable c31. Further, the end of the super top b1 is released.

Figure 20:
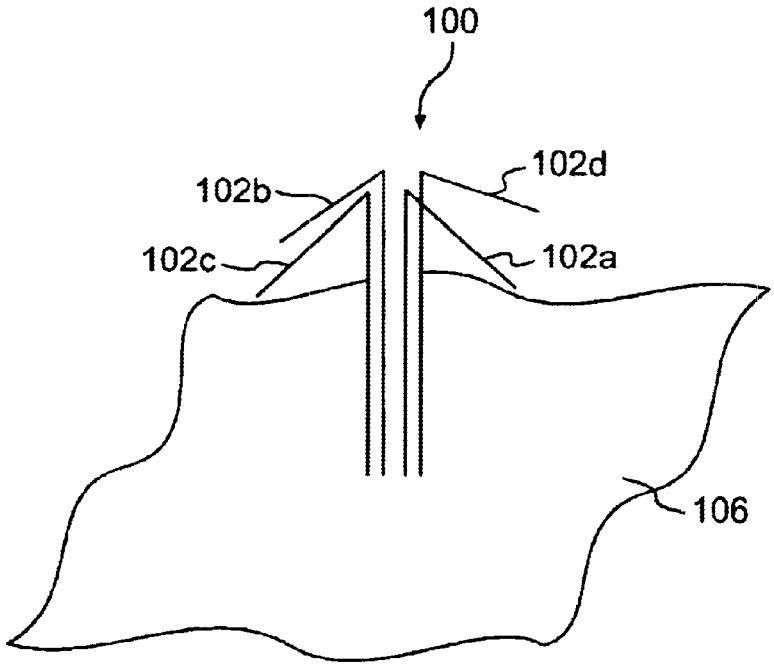
FIG. 20 PRIOR ART
FIG. 20 is a diagram showing a schematic structure of a conventional cross dipole antenna structured by employing an inverted V-shaped dipole antenna.
Figure 21:
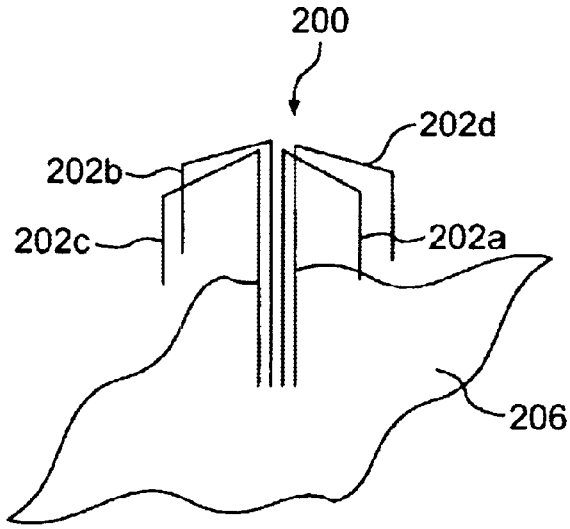
FIG. 21 PRIOR ART
FIG. 21 is a diagram showing a schematic structure of a conventional cross dipole antenna structured by employing an inverted U-shaped dipole antenna.
Figure 22:
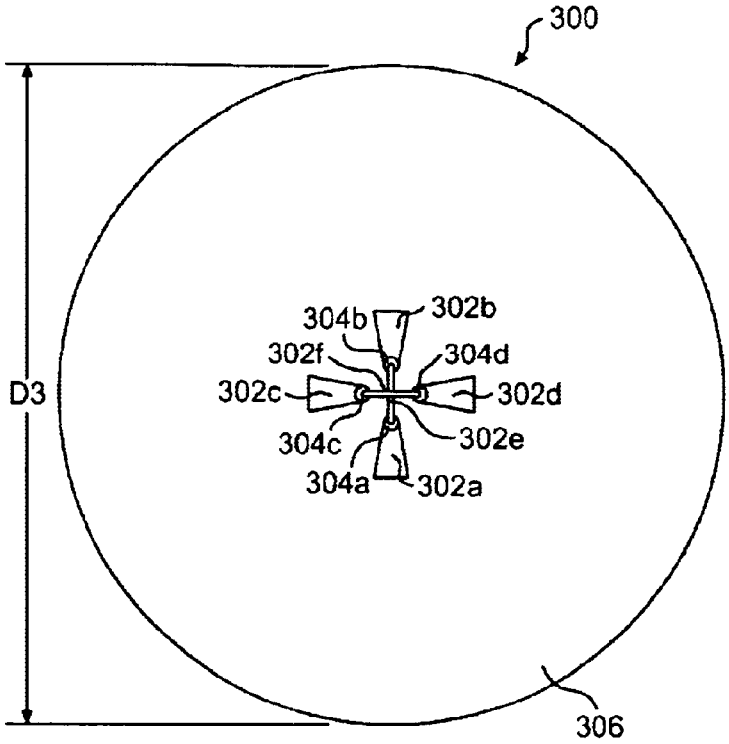
FIG. 22 PRIOR ART
FIG. 22 is a plan view showing a detailed structure of a conventional cross dipole antenna structured by employing an inverted U-shaped dipole antenna.
Figure 23:
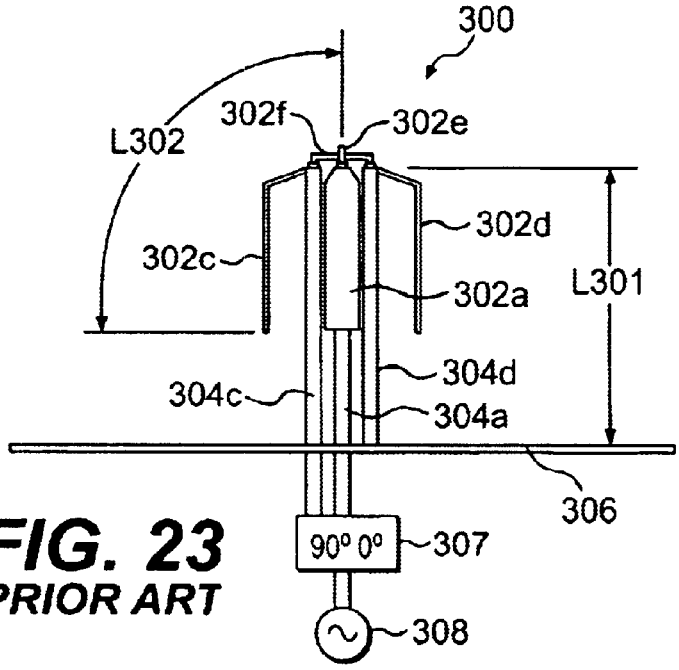
FIG. 23 PRIOR ART
FIG. 23 is a front view showing a detailed structure of a conventional cross dipole antenna structured by employing an inverted U-shaped dipole antenna.
Figure 24:
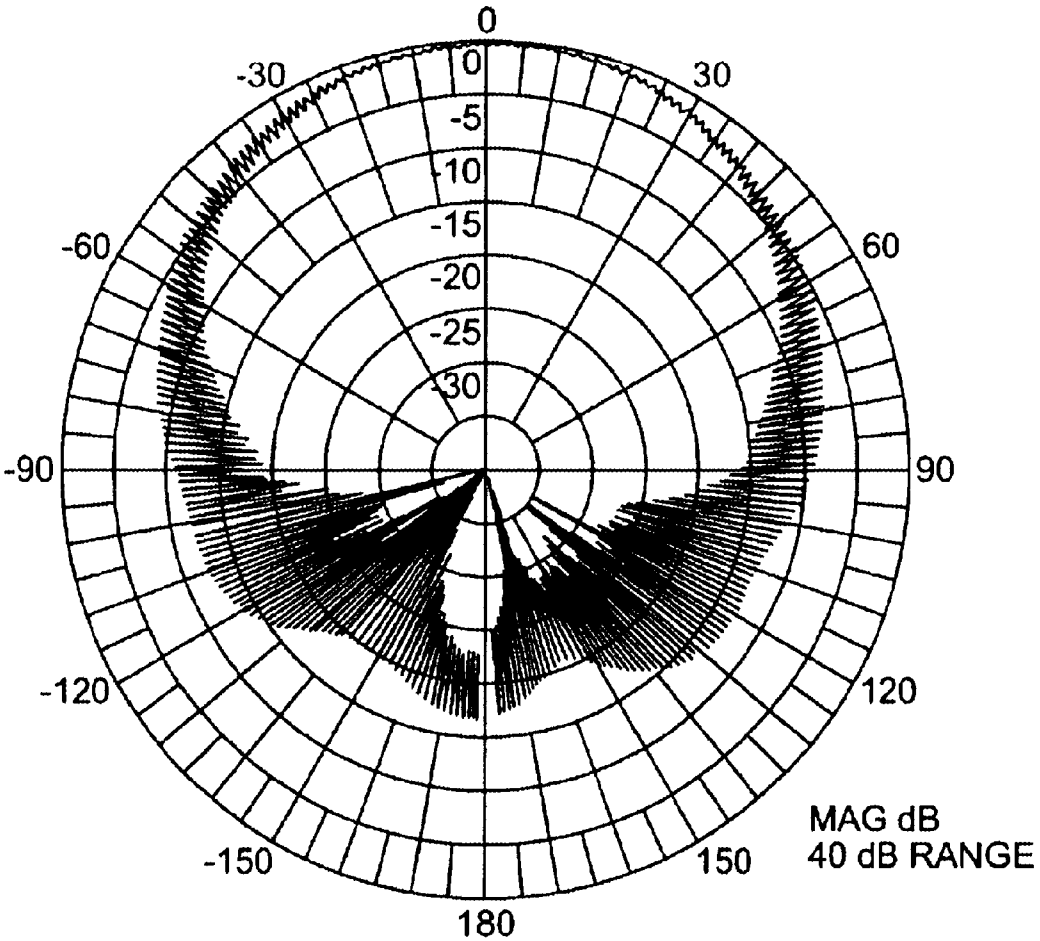
FIG. 24 PRIOR ART
FIG. 24 is a diagram showing the directivity characteristic inside the perpendicular face of a conventional cross dipole antenna structured by employing an inverted U-shaped dipole antenna.

Although dipole elements 2*a* to 2*d* and the non-feeding elements 3*a* to 3*h* are formed in a plate shape in the foregoing explanation, they may be of linear elements having a pole shape or pipe shape. Moreover, the connection of coaxial cables 4*a,* may be soldered or welded. Further, although dipole elements 2*a* to 2*d* have an inverted U shape as shown in FIG. 21, they may also take the form of an inverted V-shaped element as shown in FIG. 20.

Moreover, although the cross dipole antennae 1, 11 of the present invention are made of metal, they may also be made by forming a metal film, such as with a thin coating, on a resin surface.

Furthermore, the insulation spacers in the cross dipole antennae 1, 11 of the present invention requires, at the least, a height capable of insulating the non-feeding elements and mounting the same on the reflecting plate, and may be of an arbitrary height for the non-feeding elements to act as a wave director. Thus, the height H1 of the insulation spacers 5*a* to 5*h* in the cross dipole antenna 1 of the present invention is not limited to 0.04λ, nor is the height H2 of the insulation spacers 15*a* to 15*h* in the cross dipole antenna 11 of the present invention is not limited to 0.15λ.

Moreover, use of the cross dipole antennae 1, 11 of the present invention is not limited as antennae of satellite communication systems, and may be employed as the antennae of communication systems utilizing circularly polarized waves such as antennae for automobiles, antennae for ships and vessels, antennae for aircraft, and so on.

Figure 9:
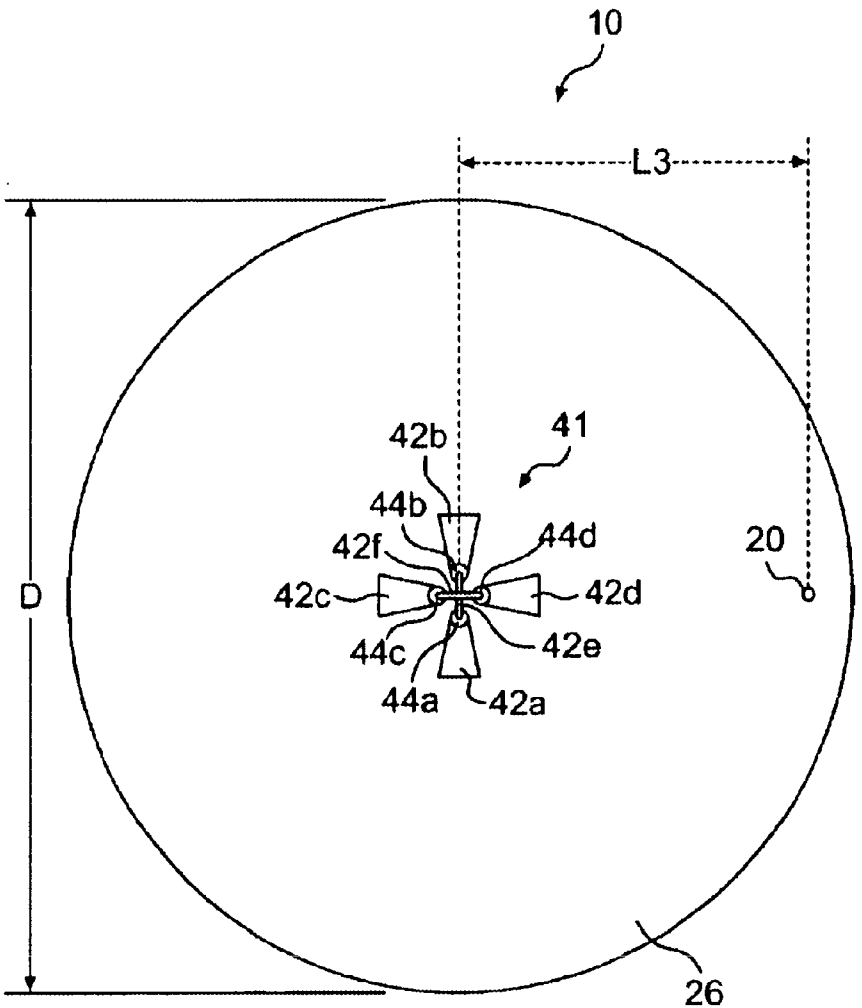
FIG. 9 is a plan view showing the structure of the first embodiment of the composite antenna of the present invention.
Figure 25:
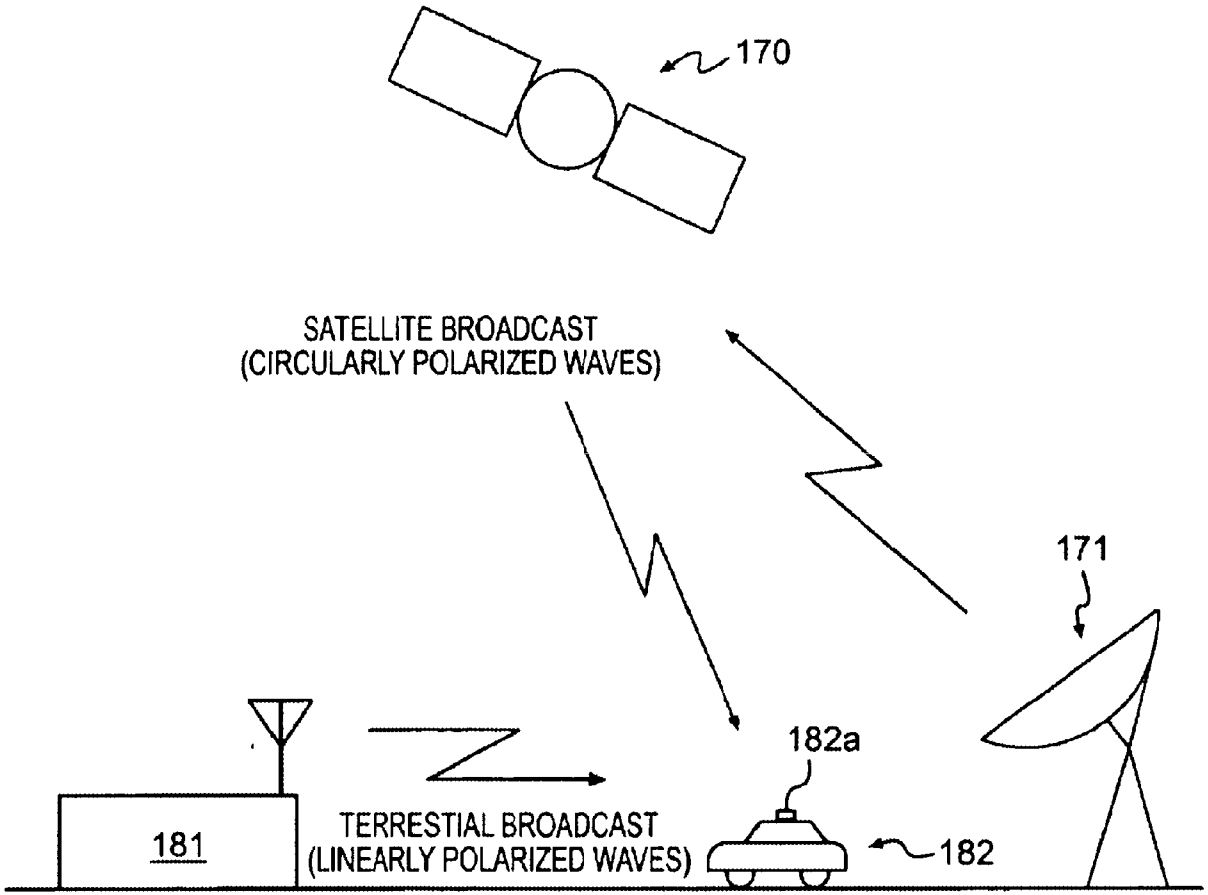
FIG. 25 PRIOR ART
FIG. 25 is a diagram showing a schematic structure of a satellite digital sound broadcast system.

The composite antenna of the present invention is now explained. With the composite antenna of the present invention, circularly polarized waves are used as the satellite broadcast as shown in FIG. 25, and is an antenna that may be employed as the antenna 182*a* installed in a mobile body 182 in a satellite digital sound broadcast system in which linearly polarized waves are used as the terrestrial broadcast. FIG. 9 illustrates a plan view showing the first structure according to the present embodiment, and FIG. 10 illustrates the front view thereof.

Figure 10:
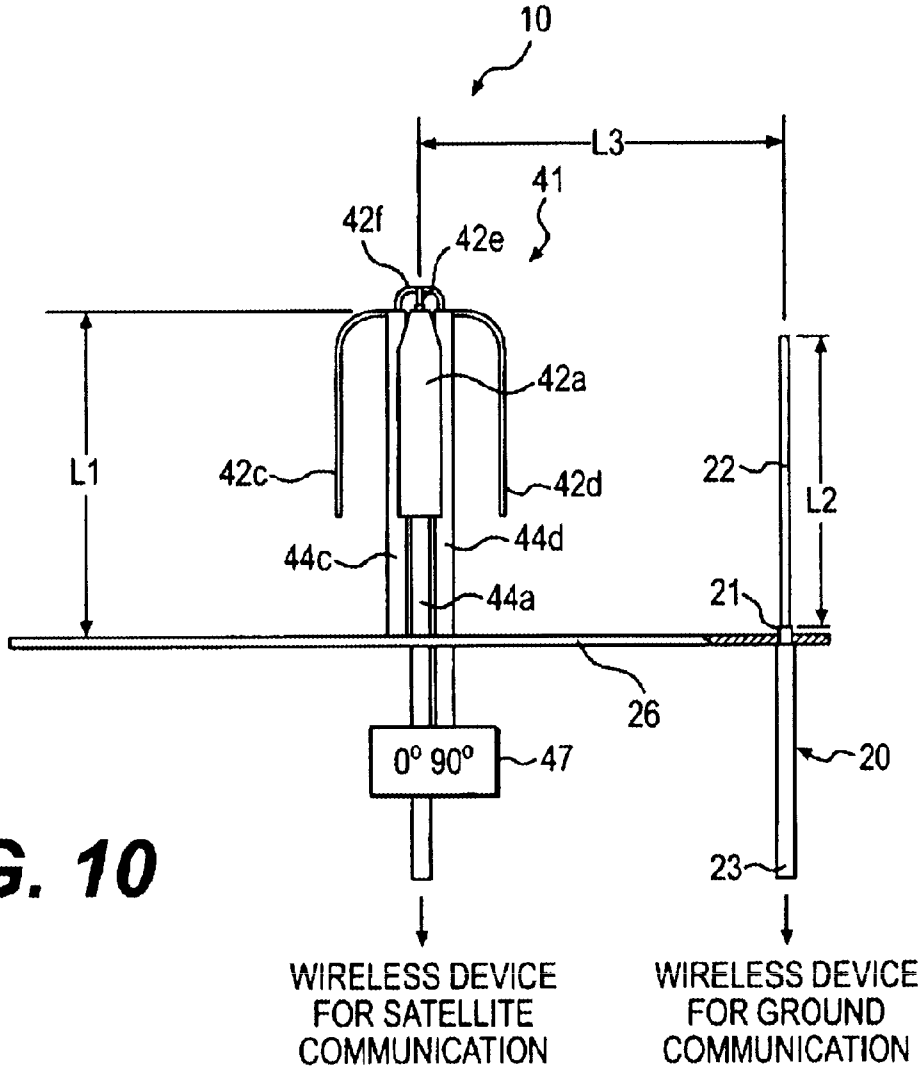
FIG. 10 is a front view showing the structure of the first embodiment of the composite antenna of the present invention.

The first composite antenna 10 according to an embodiment of the present invention shown in FIG. 9 and FIG. 10 is structured from a cross dipole antenna 41 formed of two dipole antennae disposed to be approximately orthogonal, a whip antenna 20, and a reflecting plate 26. The reflecting plate 26 is of an approximate circular form and the diameter D thereof is approximately λ/2 to λ upon setting the wavelength of the center frequency in a used frequency band to λ. The cross dipole antenna 41 is structured by disposing a first inverted U-shaped dipole antenna and a second inverted U-shaped dipole antenna to be approximately orthogonal. The first inverted U-shaped dipole antenna is structured from a dipole antenna 42*a* and a dipole antenna 42*b* folded in an inverted U shape, respectively, and the second inverted U-shaped dipole antenna is structured from a dipole antenna 42*c* and a dipole antenna 42*d* folded in an inverted U shape. Dipole antennae 42*a* to 42*d* structuring the two inverted U-shaped dipole antennae are formed in a plate shape in which the width thereof gradually becomes larger from the folded portion as shown in FIG. 10 by processing a metal plate, folded into an inverted U shape toward the reflecting plate 26, and the end thereof is made to face the reflecting plate 26. Moreover, the length of dipole antennae 42*a* to 42*d* is approximately λ/4. In other words, the first inverted U-shaped dipole antenna and second inverted U-shaped dipole antenna are half-wavelength dipole antennae.

In the cross dipole antenna 41, the length L1 shown in FIG. 10 between one end of dipole antennae 42*a* to 42*d* and the reflecting plate 26 is approximately 0.25λ to 0.4λ. The λ, however, is the wavelength of the center frequency in a used frequency band. In other words, the length from the reflecting plate 26 of a coaxial semi-rigid cable 44*a* for exciting the first inverted U-shaped dipole antenna structured from dipole antenna 42*a* and dipole antenna 42*b* is approximately 0.25 to 0.4λ. Similarly, the length from the reflecting plate 26 of a coaxial semi-rigid cable 44*d* for exciting the second inverted U-shaped dipole antenna structured from dipole antenna 42*c* and dipole antenna 42*d* is also approximately 0.25 to 0.4λ. Moreover, the length from a short pole 44*b* and short pole 44*c* in which the lower end thereof is short-circuited to the reflecting plate 26 is also approximately 0.25 to 0.4λ.

One end of the dipole antenna 42*a* is connected to and excited by a covered conductor at the tip of the coaxial semi-rigid cable 44*a,* and one end of the dipole antenna 42*b* is connected to and excited by the tip of the short pole 44*b*. A center conductor 42*e* of the coaxial semi-rigid cable 44*a* is connected to the tip of this short pole 44*b*. Further, one end of the dipole antenna 42*d* is connected to and excited by a covered conductor at the tip of the coaxial semi-rigid cable 44*d,* and one end of the dipole antenna 42*c* is connected to and excited by the tip of the short pole 44*c*. A center conductor 42*f* of the coaxial semi-rigid cable 44*d* is connected to the tip of this short pole 44*c*.

Moreover, coaxial semi-rigid cables 44*a,* 44*d* penetrating through and extending below the reflecting plate 26 are connected to a phase delay circuit 47, an excitation signal is output to the coaxial semi-rigid cable 44*a* from a wireless device for satellite communication function as the feeder unit at a 0° phase delay, and an excitation signal is output to the coaxial semi-rigid cable 44*d* from the wireless device for satellite communication functioning as the feeder unit at a 90° phase delay. Thus, as the first inverted U-shaped dipole antenna and the second inverted U-shaped dipole antenna are excited such that the phases thereof mutually shift at approximately 90° pursuant to the excitation from the wireless device for satellite communication functioning as the feeder unit, circularly polarized waves are irradiated in an approximate perpendicular direction to the face perpendicular to the face of the cross dipole antenna 41; that is, the face of the reflecting plate 26. Here, the antiphase circular polarization component irradiated in the direction of the reflecting plate 26 is reflected by the reflecting plate 26 so as to be antiphase, and it is irradiated in an approximate perpendicular upper direction to the face of the reflecting plate 26 as an in-phase with the component irradiated in the opposite direction to the reflecting plate 26.

Furthermore, the whip antenna 20 activated with perpendicular polarization is an antenna activating at the same frequency band as or adjacent frequency band to the cross dipole antenna 41 activated with circularly polarized waves, and is fixated on the reflecting plate 26. Moreover, a whip element 22 insulated from the reflecting plate 26 with an insulation spacer 21 is disposed to be approximately perpendicular. The length L3 (c.f. FIG. 9) between the whip element 22 and the cross dipole antenna 41 is set to be more than approximately $\lambda/4$ and at a length that will not affect each other. The length L2 of the whip element 22 is, for example, approximately $\lambda/4$. The length L2, however, is not limited to approximately $\lambda/4$. In other words, FIG. 19 illustrates the structural examples of the whip antenna 20, and the whip antenna 20 is not limited to the $\lambda/4$ whip antenna depicted in FIG. 19(*a*), and may also be a $\lambda/2$ antenna as depicted in FIG. 19(*b*), a $5\lambda/8$ whip antenna as depicted in FIG. 19(*c*), or a $3\lambda/4$ whip antenna as depicted in FIG. 19(*d*). In addition, the whip antenna 20 may also be of a helical antenna as shown in FIG. 19(*c*) or a sleeve antenna as shown in FIG. 19(*e*).

Returning now to FIG. 9 and FIG. 10, a semi-rigid cable 23 for feeding to the whip antenna 20 is extending at the backside of the reflecting plate 26. This semi-rigid cable 23 is connected to the wireless device for ground communication. The whip antenna 20 is thereby able to transmit and receive perpendicular polarization.

Figure 11:
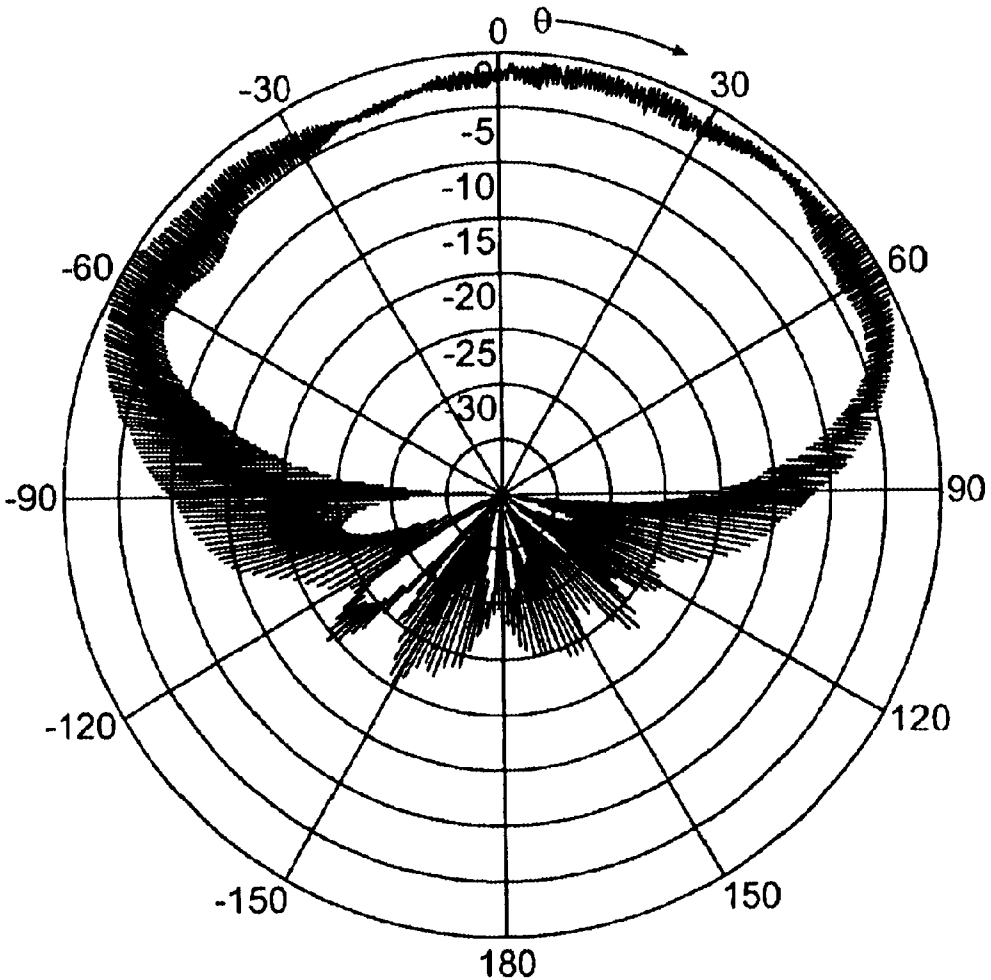
FIG. 11 is a diagram showing the directivity characteristic inside the perpendicular face of a cross dipole antenna in the first embodiment of the composite antenna of the present invention.
Figure 12:
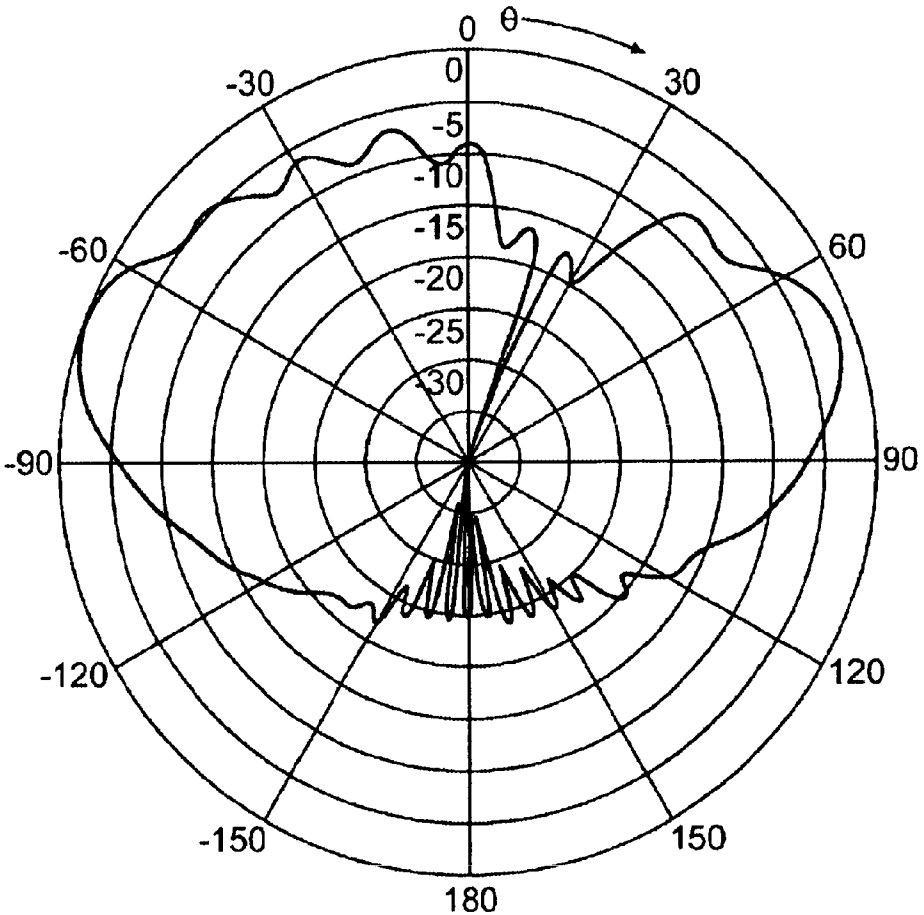
FIG. 12 is a diagram showing the directivity characteristic inside the perpendicular face of a whip antenna in the first embodiment of the composite antenna of the present invention.

Next, FIG. 11 shows the directivity characteristic inside the perpendicular face in a frequency of 2.32 GHz of the cross dipole antenna 41 in the first composite antenna 10 according to an embodiment of the present invention described above, and FIG. 12 shows the directivity characteristic inside the perpendicular face in a frequency of 2.32 GHz of the whip antenna 20. Upon reviewing FIG. 11, the cross dipole antenna 41 possesses sufficient gain in the direction where $\theta$ is −70 to +70, and the axial ratio characteristic is also favorable. Moreover, upon reviewing FIG. 12, it is clear that the whip antenna 20 is obtaining sufficient gain in perpendicular polarization even in a low elevation angle.

Accordingly, the first composite antenna 10 according to an embodiment of the present invention is capable of sufficiently receiving circularly polarized waves transmitted from a satellite by employing the cross dipole antenna 41 as the satellite system antenna. Further, it is possible to sufficiently receive perpendicular polarization transmitted on the ground as signal contents identical to the signals transmitted from a satellite by employing the whip antenna 20 as the ground system antenna. In other words, by mounting the composite antenna 10 according to the first embodiment of the present invention on a mobile body, this antenna may be used as the antenna 182*a* of the mobile body 182 in the satellite digital sound broadcast system illustrated in FIG. 25.

Figure 13:
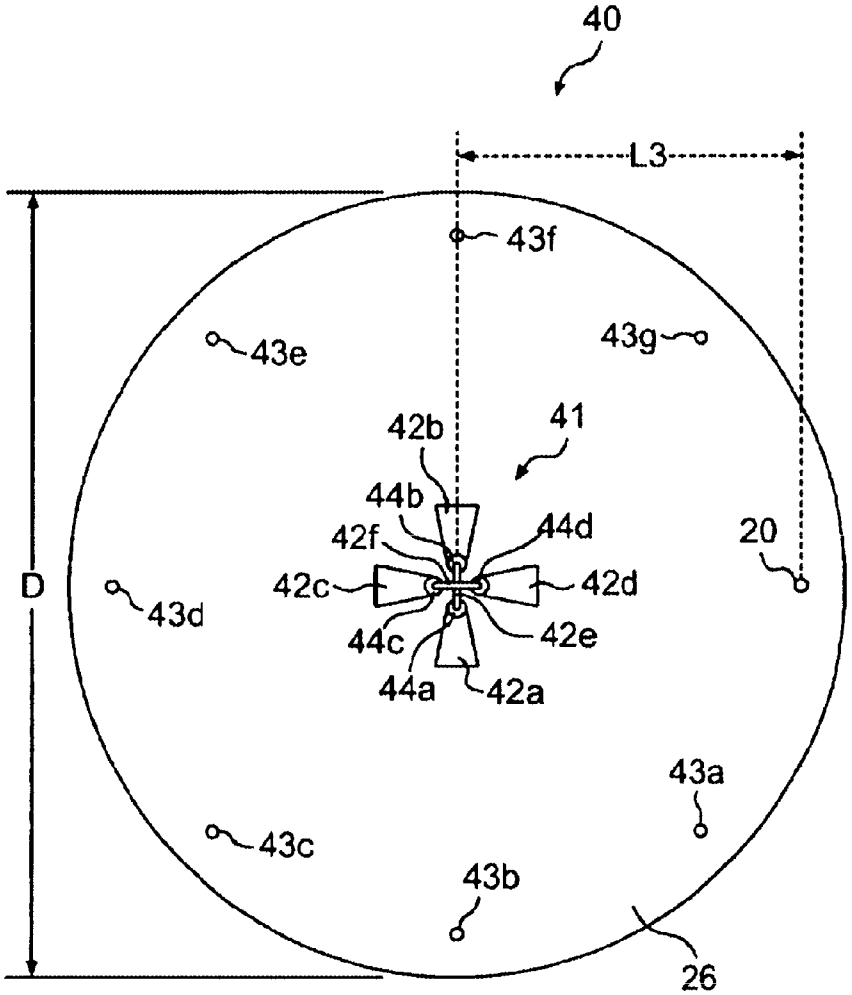
FIG. 13 is a plan view showing the structure of the second embodiment of the composite antenna of the present invention.
Figure 14:
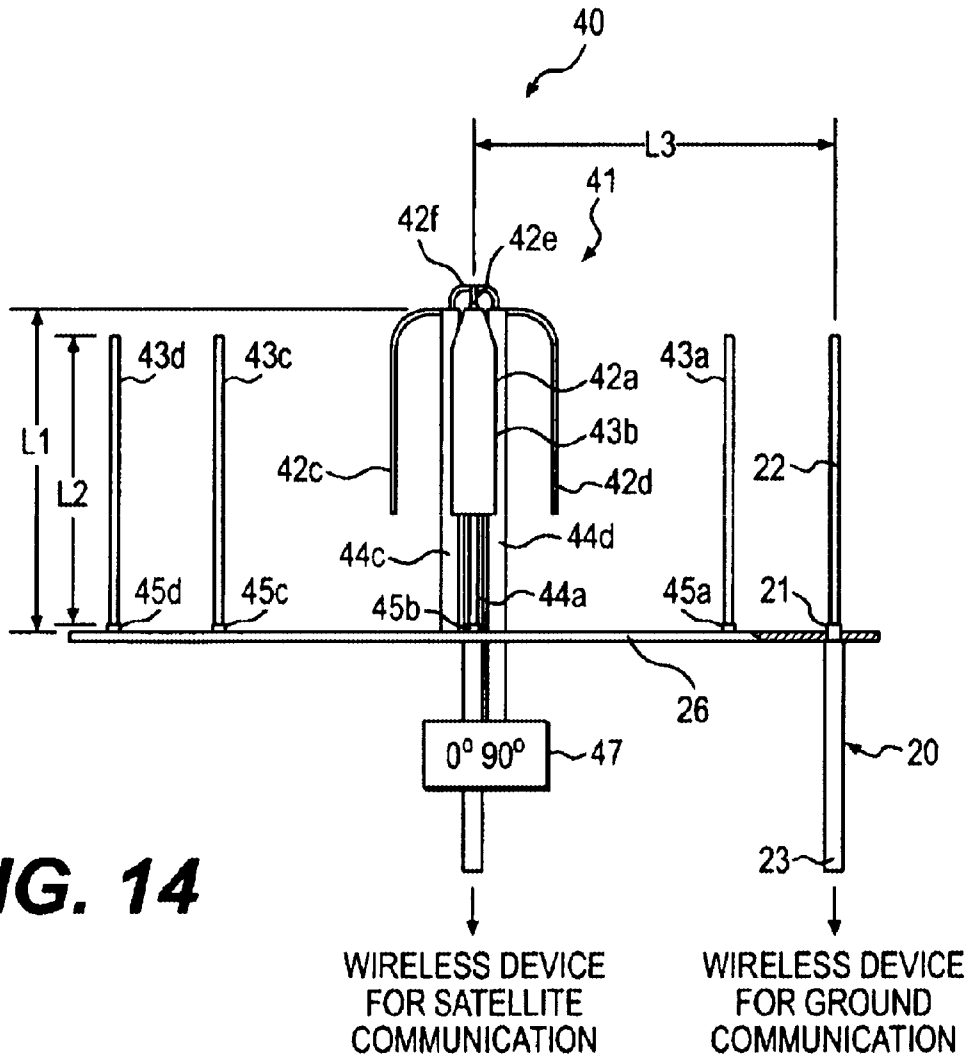
FIG. 14 is a front view showing the structure of the second embodiment of the composite antenna of the present invention.

Next, FIG. 13 illustrates the plan view showing the structure of the second composite antenna according to an embodiment of the present invention, and FIG. 14 illustrates the front view thereof. This second composite antenna also employs circularly polarized waves as the satellite broadcast as depicted in FIG. 25, and is an antenna that may be used as the antenna 182*a* mounted on the mobile body 182 in the satellite digital sound broadcast system in which linearly polarized waves are utilized for the terrestrial broadcast.

The second composite antenna 40 according to an embodiment of the present invention illustrated in FIG. 13 and FIG. 14 is an antenna having a plurality of non-feeding elements 43*a* to 43*g* around the cross dipole antenna 41 in the composite antenna 10 according to the first embodiment. The number of non-feeding elements 43*a* to 43*g* is, for example, 7 elements, and they are disposed at even intervals on the circumference to which the whip antenna 20 is disposed.

Moreover, the non-feeding elements 43*a* to 43*g* are uprising approximately perpendicular from and fixated to the reflecting plate 26. The length L2 of these non-feeding elements 43*a* to 43*g* and the whip antenna 20 is approximately $\lambda/4$, and insulation spacers 45*a* to 45*g* are respectively provided to the lower end of the non-feeding elements 43*a* to 43*g* so as to be disposed by being insulated from the reflecting plate 26. The lower end of these insulation spacers 45*a* to 45*g* is fixated on the reflecting plate 26. Further, the length L3 from the non-feeding elements 43*a* to 43*g* and the center of the cross dipole antenna 41 of the whip antenna 20 is approximately $\lambda/4$ or more. Here, the cross dipole antenna 41 and the whip antenna 20 do not influence each other. The non-feeding elements 43*a* to 43*g* are formed in a pole shape as shown in FIG. 13 and FIG. 14 by processing a metal pipe.

These non-feeding elements 43*a* to 43*g* act as the wave director of the cross dipole antenna 41, and the whip antenna 20 also acts as one wave director. That is, the whip antenna 20 may also be used as a wave director.

The structure other than the non-feeding elements 43*a* to 43*g* in the second composite antenna 40 in an embodiment of the present invention is the same as that of the composite antenna 10 according to the first embodiment, and the explanation thereof is omitted.

Figure 15:
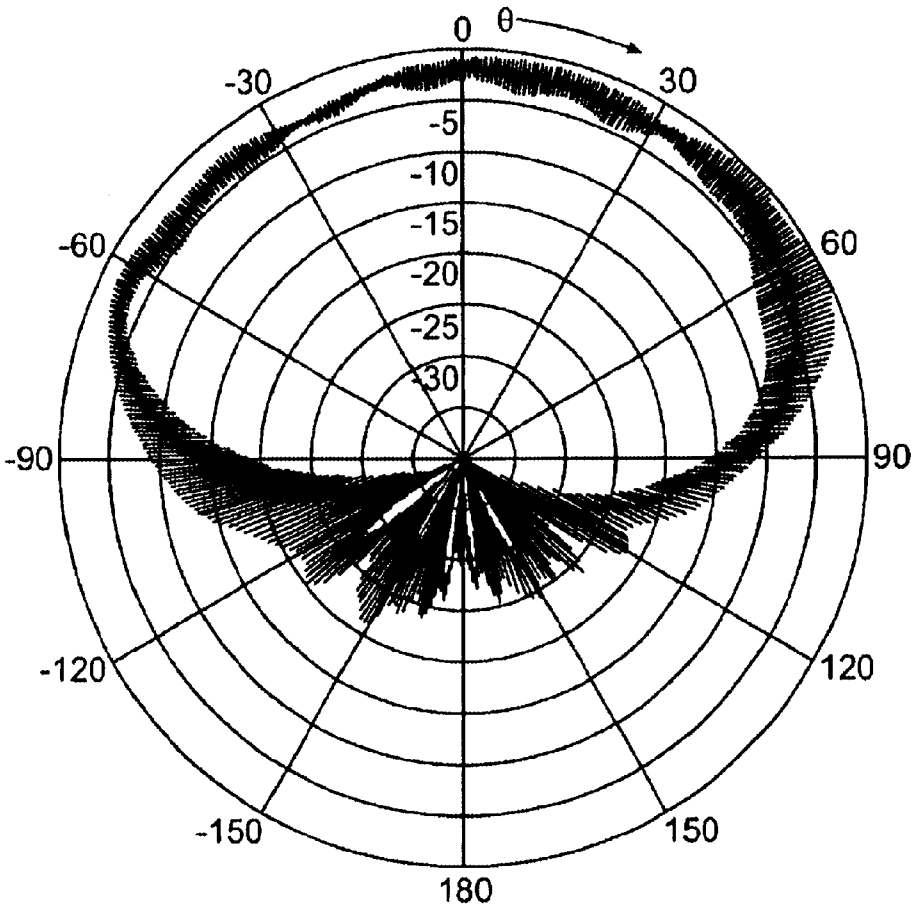
FIG. 15 is a diagram showing the directivity characteristic inside the perpendicular face of a cross dipole antenna in the second embodiment of the composite antenna of the present invention.

Next, FIG. 15 shows the directivity characteristic inside the perpendicular face in a frequency of 2.32 GHz of the cross dipole antenna 41 including non-feeding element 43*a* to 43*g* in the second composite antenna 40 according to an embodiment of the present invention described above, and FIG. 16 shows the directivity characteristic inside the perpendicular face in a frequency of 2.32 GHz of the whip antenna 20. Upon reviewing FIG. 15, it is clear that the gain is significantly improved in a low elevation angle in comparison to the directivity characteristic inside the perpendicular face of the composite antenna 10 according the first embodiment shown in FIG. 11, Moreover, upon reviewing FIG. 16, it is clear that the directivity characteristic of the whip antenna 20 is approximate to that of the composite antenna 10 according to the first embodiment shown in FIG. 12, and sufficient gain of perpendicular polarization can be obtained in a low elevation angle even when used as a wave director.

Accordingly, the second composite antenna 40 according to an embodiment of the present invention is capable of sufficiently receiving circularly polarized waves transmitted from a satellite by employing the cross dipole antenna 41 as the satellite system antenna. Further, it is possible to sufficiently receive perpendicular polarization transmitted on the ground as signal contents identical to the signals transmitted from a satellite by employing the whip antenna 20 as the ground system antenna. In other words, by mounting the composite antenna 40 according to the second embodiment of the present invention on a mobile body, this antenna may be used as the antenna 182*a* of the mobile body 182 in the satellite digital sound broadcast system illustrated in FIG. 25.

Figure 17:
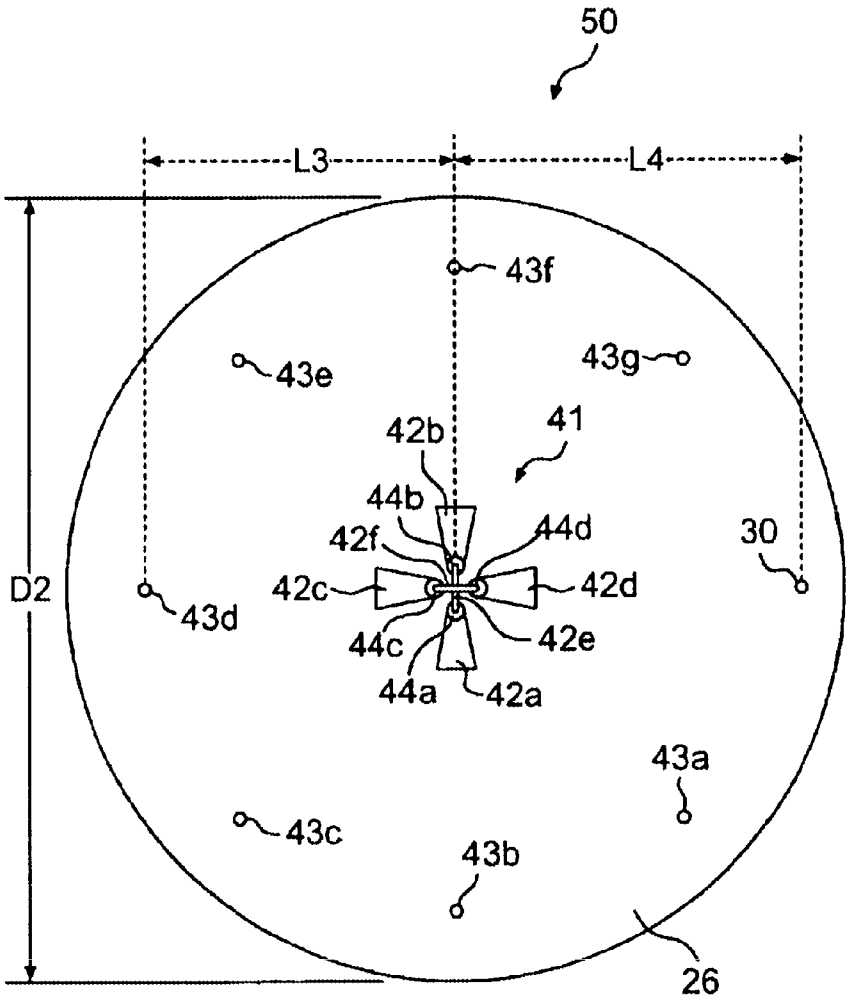
FIG. 17 is a plan view showing the structure of the third embodiment of the composite antenna of the present invention.
Figure 18:
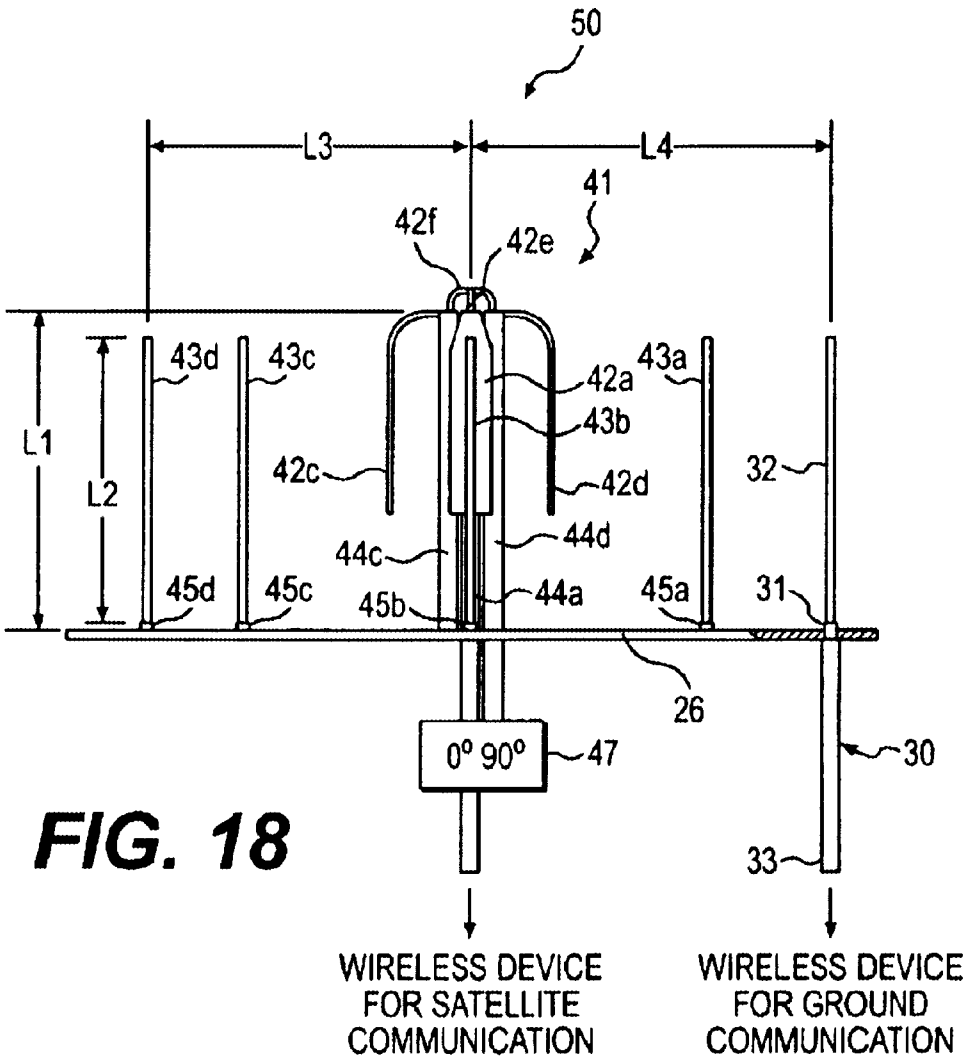
FIG. 18 is a front view showing the structure of the third embodiment of the composite antenna of the present invention.
Figure 19A:
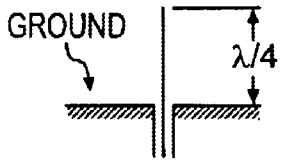
FIG. 19A illustrates a whip antenna in accordance with one embodiment of the invention.
Figure 19B:
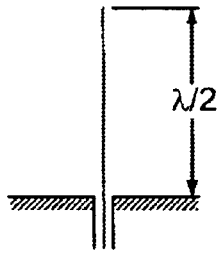
FIG. 19B illustrates a half-wavelength whip antenna in accordance with another embodiment of the invention.
Figure 19C:
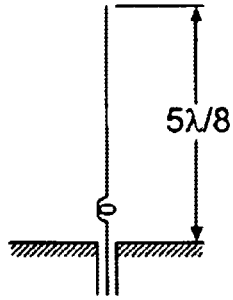
FIG. 19C illustrates a ⅝ wavelength whip antenna in accordance with still another embodiment of the invention.
Figure 19D:
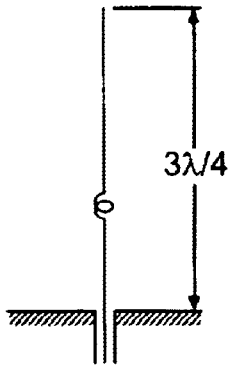
FIG. 19D illustrates a ¾ wavelength whip antenna in accordance with yet another embodiment of the invention.
Figure 19E:
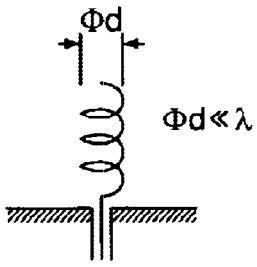
FIG. 19E illustrates a whip antenna in the form of a helical antenna.
Figure 19F:
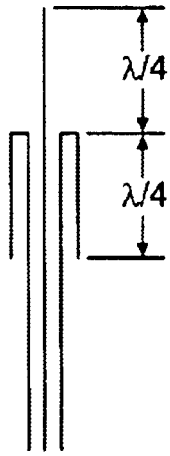
FIG. 19F illustrates the whip antenna in the form of a sleeve antenna.

Next, FIG. 17 illustrates the plan view showing the structure of the third composite antenna according to an embodiment of the present invention, and FIG. 18 illustrates the front view thereof. This third composite antenna also employs circularly polarized waves as the satellite broadcast as depicted in FIG. 25, and is an antenna that may be used as the antenna 182*a* mounted on the mobile body 182 in the satellite digital sound broadcast system in which linearly polarized waves are utilized for the terrestrial broadcast.

The third composite antenna 50 according to an embodiment of the present invention shown in FIG. 17 and FIG. 18 is structured from a cross dipole antenna 41 formed of two dipole antennae disposed to be approximately orthogonal, a whip antenna 30, and a reflecting plate 26. The reflecting plate 26 is of an approximate circular form and the diameter D2 thereof is approximately $\lambda/2$ to $\lambda$ upon setting the wavelength of the center frequency in a used frequency band to $\lambda$. The structure of the cross dipole antenna 41 is the same as the composite antenna 40 according to the second embodiment of the present invention and comprises the non-feeding elements 43*a* to 43*g*, and the explanation thereof is omitted as it has been described above.

The whip antenna 30 is an antenna activating in the same frequency band as with the cross dipole antenna 41, and is fixated to the end on the reflecting plate 26. The whip element is insulated from the reflecting plate 26 with the insulation spacer 31 and disposed to be approximately perpendicular. The length L4 between the whip element 32 and the cross dipole antenna 41 exceeds approximately $\lambda/4$ and is within $\lambda$ so as to be length which lessens the influence on each other, and disposed on the outer side of the non-feeding elements 43*a* to 43*g*. The length of the whip element 32 is, for example, approximately $\lambda/4$. The length of the whip element 32, however, is not limited to approximately $\lambda/4$, and the whip antenna 30 may be replaced by any of the antennae illustrated in FIGS. 19(*a*) to (*f*). Since the whip antenna 30 is disposed to be isolated further from the cross dipole antenna 41, the mutual influence between the whip antenna 30 and the cross dipole antenna 41 can be further lightened.

Figure 16:
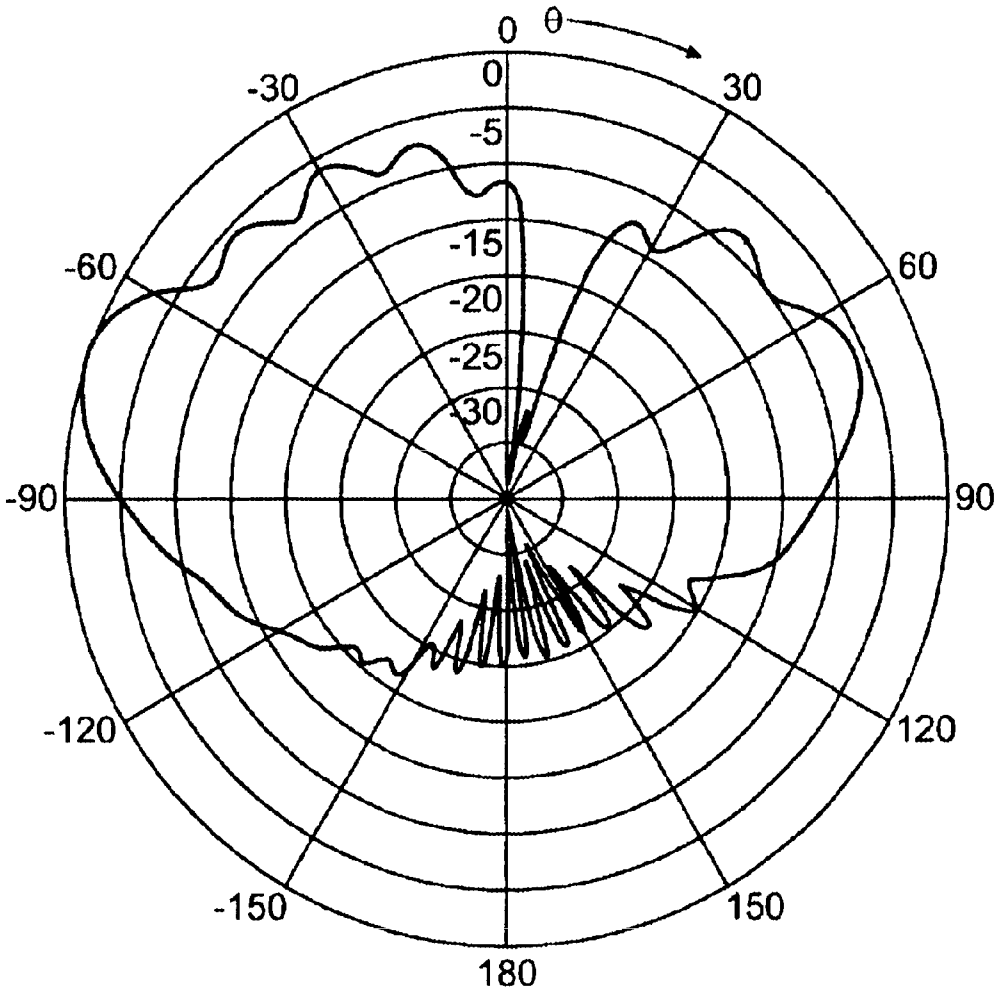
FIG. 16 is a diagram showing the directivity characteristic inside the perpendicular face of a whip antenna in the second embodiment of the composite antenna of the present invention.

The directivity characteristic inside the perpendicular face of the cross dipole antenna 41 including the non-feeding elements 43*a* to 43*g* in the third composite antenna 50 according to an embodiment of the present invention is approximately as shown in FIG. 15, and the directivity characteristic inside the perpendicular face of the whip antenna 30 is approximately as shown in FIG. 16. In other words, the gain in a low elevation angle is significantly improved and the ratio characteristic in a low elevation angle is also significantly improved. Moreover, the directivity characteristic inside the perpendicular face of the whip antenna 30 is capable of obtaining sufficient gain in a low elevation angle even when being used as a wave director.

Accordingly, the third composite antenna 50 according to an embodiment of the present invention is capable of sufficiently receiving circularly polarized waves transmitted from a satellite by employing the cross dipole antenna 41 as the satellite system antenna. Further, it is possible to sufficiently receive perpendicular polarization transmitted on the ground as signal contents identical to the signals transmitted from a satellite by employing the whip antenna 30 as the ground system antenna. In other words, by mounting the composite antenna 50 according to the third embodiment of the present invention on a mobile body, this antenna may be used as the antenna 182*a* of the mobile body 182 in the satellite digital sound broadcast system illustrated in FIG. 25.

Meanwhile, the reflecting plate 26 in the first composite antennae 10 according to an embodiment of the present invention through the third composite antenna 50 according to the third embodiment described above is not limited to a flat plate shape, and may be a reflecting plate having the shapes shown in FIG. 6. In other words, the reflecting plate 26 may be a reflecting plate 16*a* shown in FIGS. 6(*a*), (*b*) having a shape of cutting away a sphere, a conical reflecting plate 16*b* shown in FIGS. 6(*c*), (*d*) wherewith the magnetic dip changes in two stages, or a trapezoidal reflecting plate 16*c* shown in FIG. 6(*e*) wherewith the apex portion of the conical shape is flat. The reflecting plate 26 may also constitute a conical shape as with the reflecting plate 16 depicted in FIG. 5. A reflecting plate having any of the foregoing shapes is able to suppress the decrease of gain in a low elevation angle and to significantly improve the axial ratio characteristic of circularly polarized waves.

The whip antennae 20, 30 in the first composite antenna 10 according to an embodiment of the present invention through the composite antenna 50 according to the third embodiment are not limited to the $\lambda/4$ whip antenna depicted in FIG. 19(*a*), and may also be a $\lambda/2$ antenna as depicted in FIG. 19(*b*), a $5\lambda/8$ whip antenna as depicted in FIG. 19(*c*), or a $3\lambda/4$ whip antenna as depicted in FIG. 19(*d*). In addition, the whip antennae 20, 30 may also be of a helical antenna as shown in FIG. 19(*e*) or a sleeve antenna as shown in FIG. 19(*f*).

Meanwhile, with respect to the cross dipole antenna 41 in the first composite antenna 10 according to an embodiment of the present invention through the composite antenna 50 according to the third embodiment, a balanced-unbalanced circuit is provided for converting the unbalanced circuit (coaxial semi-rigid cable) into a balanced circuit (dipole element) since the dipole element is excited with a coaxial semi-rigid cable. This balanced-unbalanced circuit may be any one of the balanced-unbalanced circuits shown in FIGS. 8(*a*) to (*d*) described above. The description of the balanced-unbalanced circuit shown in FIG. 8(*a*) is omitted since it has been explained above.

In the composite antenna according to the present invention described above, the decoded signal of the circularly polarized waves received from the cross dipole antenna 41 and the decoded signal of the linearly polarized waves received from the whip antennae 20, 30 are of the identical signal contents and synchronized. Further, with the wireless device for satellite communication and the wireless device for ground communication to which the signals received by the composite antenna according to the present invention are directed, they respectively detect the reception power, SN ratio and the like of the received signals and select a reception signal that can be more favorably received. Thereby, in areas of cities and so on where transmission signals from a satellite fall short, favorable reception is realized by receiving linearly polarized waves transmission signals from the ground in place of the transmission signals from a satellite.

Industrial Applicability

With the cross dipole antenna of the present invention described above, since a plurality of non-feeding elements are provided so as to be disposed around the approximately orthogonal first dipole antenna and second dipole antenna and uprising from the reflecting plate, it is possible to suppress the decrease of gain in a low elevation angle and to significantly improve the axial ratio characteristic of circularly polarized waves. In other words, the non-feeding elements act as the wave director and improve the antenna characteristic in the direction of the low elevation angle.

Moreover, by forming the reflecting plate such that the peripheral portion is inclined downward so as to be positioned lower than the center portion, it is possible to suppress the decrease of gain in a low elevation angle and to significantly improve the axial ratio characteristic of circularly polarized waves.

Furthermore, with the composite antenna of the present invention, since a whip antenna capable of transmitting and receiving linearly polarized waves is provided on the reflecting plate structuring the cross dipole antenna, installation of a single composite antenna will enable the reception of both linearly polarized waves and circularly polarized waves. Therefore, upon receiving digital sound broadcast with a mobile reception terminal, it is no longer necessary to install two antennae; namely, a satellite antenna and a ground antenna, and a single composite antenna will suffice.

Moreover, by disposing a plurality of non-feeding elements around the cross dipole antenna, it is possible to suppress the decrease of gain in a low elevation angle and to significantly improve the axial ratio characteristic of circularly polarized waves. In other words, the non-feeding elements act as the wave director and improve the antenna characteristic in the direction of the low elevation angle. Further, since a whip antenna, which is a ground antenna, can also be used as the non-feeding element, a composite antenna can be structured with only an approximate structure of a cross dipole antenna, and the composite antenna can thereby be miniaturized.

Furthermore, by forming the reflecting plate such that the peripheral portion is inclined downward so as to be positioned lower than the center portion, it is possible to further suppress the decrease of gain in a low elevation angle and to significantly improve the axial ratio characteristic of circularly polarized waves.

What is claimed is:

1. A cross dipole antenna, comprising:

a reflecting plate;

a first dipole antenna disposed at a prescribed interval on said reflecting plate;

a second dipole antenna disposed at a prescribed interval on said reflecting plate so as to be approximately orthogonal to said first dipole antenna; and a plurality of non-feeding conductive elements disposed around said first dipole antenna and said second dipole antenna and spaced therefrom, said non-feeding elements extending substantially orthongonal to said reflecting plate.

2. A cross dipole antenna according to claim 1, wherein said first dipole antenna and said second dipole antenna are structured by being folded toward said reflecting plate.

3. A cross dipole antenna according to claim 1, wherein said non-feeding elements are fixated on said reflecting plate via insulation spacers.

4. A cross dipole antenna, comprising:

a reflecting plate formed having a reflecting face inclined such that a center portion protrudes further than a peripheral portion;

a first dipole antenna disposed at a prescribed interval on said reflecting plate; and a second dipole antenna disposed at a prescribed interval on said reflecting plate so as to be approximately orthogonal to said first dipole antenna.

5. A cross dipole antenna according to claim 4, wherein said first dipole antenna and said second dipole antenna are structured by being folded toward said reflecting plate.

6. A cross dipole antenna according to claim 4, further comprising a plurality of non-feeding elements disposed around said first dipole antenna and said second dipole antenna and uprising from said reflecting plate.

7. A cross dipole antenna according to claim 6, wherein said non-feeding elements are fixated on said reflecting plate via insulation spacers.

8. A composite antenna in which a cross dipole antenna receives circularly polarized waves, and a whip antenna which receives linearly polarized waves of an identical or adjacent frequency band to said circularly polarized waves are provided on a reflecting plate;

wherein said cross dipole antenna comprises a first dipole antenna disposed at a prescribed interval on said reflecting plate and a second dipole antenna disposed at a prescribed interval on said reflecting plate so as to be approximately orthogonal to said first dipole antenna;

said whip antenna is fixated on said reflecting plate and isolated from said cross dipole antenna by a distance greater than approximately ¼ wavelength of the wavelength in the center frequency of the frequency band of said composite antenna; and said cross dipole antenna receiving broadcast signals of circularly polarized waves transmitted from a satellite and said whip antenna receiving broadcast signals of linearly polarized waves of identical contents as with said broadcast signals transmitted from a ground station.

9. A composite antenna in which a cross dipole antenna receives circularly polarized waves and a whip antenna for receiving linearly polarized waves of an identical or adjacent frequency band to said circularly polarized waves are provided on a reflecting plate;

wherein said cross dipole antenna comprises a first dipole antenna disposed at a prescribed interval on said reflecting plate, a second dipole antenna disposed at a prescribed interval on said reflecting plate so as to be approximately orthogonal to said first dipole antenna, and a plurality of non-feeding elements disposed around said first dipole antenna and said second dipole antenna and uprising from said reflecting plate;

said whip antenna is fixated on said reflecting plate by being isolated from said cross dipole antenna by a distance corresponding to more than approximately ¼ wavelength of the wavelength in the center frequency of the composite antenna frequency band; and said whip antenna is also used as said non-feeding elements.

10. A composite antenna according to claim 9, wherein said first dipole antenna and said second dipole antenna are structured by being folded toward said reflecting plate.

11. A composite antenna according to claim 9, wherein said non-feeding elements are fixated on said reflecting plate with insulation spacers interposed therebetween.

12. A composite antenna according to claim 9, wherein the reflecting face is inclined such that the center portion of said reflection plate protrudes further than the peripheral portion.

13. A composite antenna according to claim 9, wherein said cross dipole antenna receives broadcast signals of circularly polarized waves transmitted from a satellite and said whip antenna receives broadcast signals of linearly polarized waves of identical contents as with said broadcast signals transmitted from a ground station.

14. A composite antenna according to claim 9, wherein said plurality of non-feeding elements are disposed circumferentially with said cross dipole antenna in the approximate center, and said whip antenna is disposed outside of said circumference.

* * * * *